US006134861A

United States Patent [19]

Spude

[11] Patent Number: 6,134,861

[45] Date of Patent: Oct. 24, 2000

[54] FOUNDATION CONSTRUCTION METHOD

[76] Inventor: Gerald T. Spude, 6628 Westslope La., Oconto, Wis. 54153

[21] Appl. No.: 09/370,312

[22] Filed: Aug. 9, 1999

Related U.S. Application Data

[63] Continuation of application No. 08/837,325, Apr. 11, 1997, abandoned, which is a continuation-in-part of application No. 08/700,812, Aug. 21, 1996, Pat. No. 5,809,726.

[51] Int. Cl.[7] ..... E04G 21/00; B60R 27/00

[52] U.S. Cl. ..... 52/745.1; 52/169.12; 52/586.1; 52/780; 52/DIG. 3

[58] Field of Search ..... 52/169.12, 202, 52/285.1, 344, 477, 515, 585.1, 586.1, 586.2, 592.1, 745.09, 745.1, 747.12, 763, 765, 780, 781.3, DIG. 3

[56] References Cited

U.S. PATENT DOCUMENTS

| | | | |
|---|---|---|---|
| 2,787,812 | 4/1957 | Long | 53/780 X |
| 3,827,201 | 8/1974 | Struben | 52/DIG. 3 X |
| 4,805,361 | 2/1989 | Mason et al. | 52/DIG. 3 X |
| 5,611,182 | 3/1997 | Spude | 52/562 X |
| 5,709,058 | 1/1998 | Shaw | 52/780 X |
| 5,809,726 | 9/1998 | Spude | 52/562 X |

*Primary Examiner*—Carl D. Friedman
*Assistant Examiner*—Kevin D. Wilkens
*Attorney, Agent, or Firm*—Michael Best & Friedrich LLP

[57] ABSTRACT

A building system and apparatus for forming a wall. U-shaped channels and H-shaped or T-shaped members coupled at their sides by rigid links hold foam panels in a desired spaced relationship. Vertically oriented panels aligned and connected by T-shaped members or horizontally oriented panels stacked with and connected by H-shaped members are inserted into the U-shaped channels to form a structure of the desired length. Concrete is poured between the panels and members where it hardens to form a structural wall. The planar surfaces of the U-shaped, H-shaped and T-shaped members enable the members to be extruded, or roll formed, thereby substantially reducing member production costs. Furthermore, widely available conventional foam panels can be used, reducing panel production costs.

27 Claims, 30 Drawing Sheets

FOUNDATION CONSTRUCTION METHOD

RELATED APPLICATION

This application is a continuation of U.S. patent application Ser. No. 08/837,325, filed on Apr. 11, 1997 (abandoned), which is a continuation-in-part of U.S. patent application Ser. No. 08/700,832, filed on Aug. 21, 1996 and issued on Sep. 22, 1998 as U.S. Pat. No. 5,809,726.

BACKGROUND OF THE INVENTION

This invention relates generally to building construction form systems and, more particularly, to building construction form systems for forming foundations and the like.

Concrete foundations have typically been constructed using expensive reusable forms. These forms have typically been heavy and extremely labor-intensive to assemble. Various other form systems have been proposed to reduce construction expense. These systems typically reduce labor costs and expense through the use of light and inexpensive materials that can be left in place after concrete or other building materials are poured into the form system.

Although effective, these alternate systems are not without drawbacks. Typically, these designs require parts that are formed by injection molding, which is an expensive process requiring expensive tooling. Injection molding has also limited the practical length of the parts that can be produced to around nine feet. These relatively short lengths increase labor costs by increasing the number of connections required in the assembly process.

Previous designs have generally required complex shapes and relatively complex assembly procedures. This complexity increased training costs and decreased efficiency while workers learned to use the system. Further, this complexity increased tooling costs.

Leveling the top of the form has also been difficult and labor-intensive with previous designs. It is critical to have a level foundation upon which to build, yet prior art designs have generally not provided a convenient way of achieving a level configuration.

Another important design criterion concerns connection to abutting pieces and the ability to form corners without requiring complex pieces produced by labor-intensive operations. Previous designs have necessitated the use of special pieces which increase tooling costs and increase the complexity of the design. Further, appropriate inventories of each of the pieces had to be accurately established to avoid costly delays midway through the project as more pieces of a certain type were purchased and transported to the job site.

It is therefore an object of the present invention to provide a novel building form system and apparatus.

It is a further object of the present invention to provide an improved form system and apparatus that provides attachment surfaces to which drywall can be coupled to meet existing building code requirements.

It is a further object of the invention to provide a form system that is easy to use and that reduces training costs by eliminating numerous special use pieces required by many previous designs.

It is yet another object of the invention to reduce time and effort required to set up a building form system by eliminating the need for scaffolding or other above ground framework for erection of form systems of substantial height.

It is a further object of the invention to provide a novel building form method and apparatus using substantially vertically oriented support members that perform both panel retention and system reinforcement functions.

It is a further object of the invention to eliminate complex exterior bracing formerly necessary to prevent the form system from bulging as liquid building material is poured into the system.

It is a further object of another preferred embodiment of the invention to provide a novel method of erecting a substantially vertically oriented form system and apparatus by installing panels and support members individually from ground level along tracks provided by the invention.

It is a further object of another preferred embodiment of the invention to provide an improved method of installing a component between interior and exterior panel alignments of the form system, without the need to disassemble the form system, by raising an individual panel vertically from the ground level.

SUMMARY OF THE INVENTION

The invention provides a building form system and apparatus including T-shaped and U-shaped lengths of extruded plastic or steel coupled at their sides by rigid links. The links are preferably coupled at ninety degree angles along the lengths of the T-shaped and U-shaped elongated members. The T-shaped members are erected in a substantially vertical orientation and the bottom edges of the T-shaped members are inserted into channels of the U-shaped members. The bottom edges of panels, such as polystyrene boards, are inserted in channels in the U-shaped lengths to retain the panels in a spaced-apart relationship and a vertical orientation. This spacing enables flow of hardenable liquid building material (e.g., concrete) between the panels and the T-shaped and U-shaped elongated members. The panels are connected laterally using the T-shaped members, the flanges of which are inserted into milled slots in the lateral edges of the panels.

In one alternative embodiment of the invention, substantially vertically oriented H-shaped elongated members are substituted for the T-shaped members. The panels can be aligned and connected by inserting the flanges of the H-shaped member into milled slots in the lateral edges of the panels. The T-shaped or H-shaped members and panels are available in (or can be cut to) various lengths to create a structure of desired height. The vertical orientation of the T-shaped or H-shaped members also acts as a load bearing system once the liquid building material has hardened, increasing the load bearing strength of the wall.

Another preferred embodiment of the invention provides a building form system and apparatus including H-shaped and U-shaped lengths of extruded plastic or steel coupled at their sides by rigid links. The links are coupled at ninety degree angles along the lengths of the H-shaped and U-shaped elongated members. Panels, such as polystyrene boards, are received in channels in the H-shaped and U-shaped lengths to retain the wall panels in a spaced-apart relationship. This spacing enables flow of hardenable liquid building material (e.g., concrete) between the panels and the H-shaped and U-shaped elongated members. The panels and H-shaped lengths can be stacked upon each other to create a structure of desired height.

In all the aforementioned embodiments, the T-shaped, H-shaped and U-shaped lengths enable coupling of drywall and other building materials to the assembly formed by the T-shaped, H-shaped and U-shaped elongated members, the links, the panels and the hardened building material. The links prevent compression or expansion of the form system so that the resulting structure is of the desired dimension.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

FIG. 16A illustrates the coupling of an corner post to a substantially vertically oriented panel using a substantially vertically oriented T-shaped member. FIG. 16B illustrates the coupling of two vertically oriented T-shaped members coupled using substantially rigid links to the panel. FIG. 16C illustrates the coupling of a second substantially vertically oriented panel perpendicular to the first said panel using a T-shaped member. FIG. 16D illustrates the coupling of a preformed corner panel to the interior T-shaped member described in FIG. 16B. FIG. 16E illustrates the coupling of the preformed corner panel described in FIG. 16D to the panel described in FIG. 16C using two substantially vertically oriented T-shaped members coupled with substantially rigid links.

DETAILED DESCRIPTION OF PREFERRED EMBODIMENTS

Figure 1:
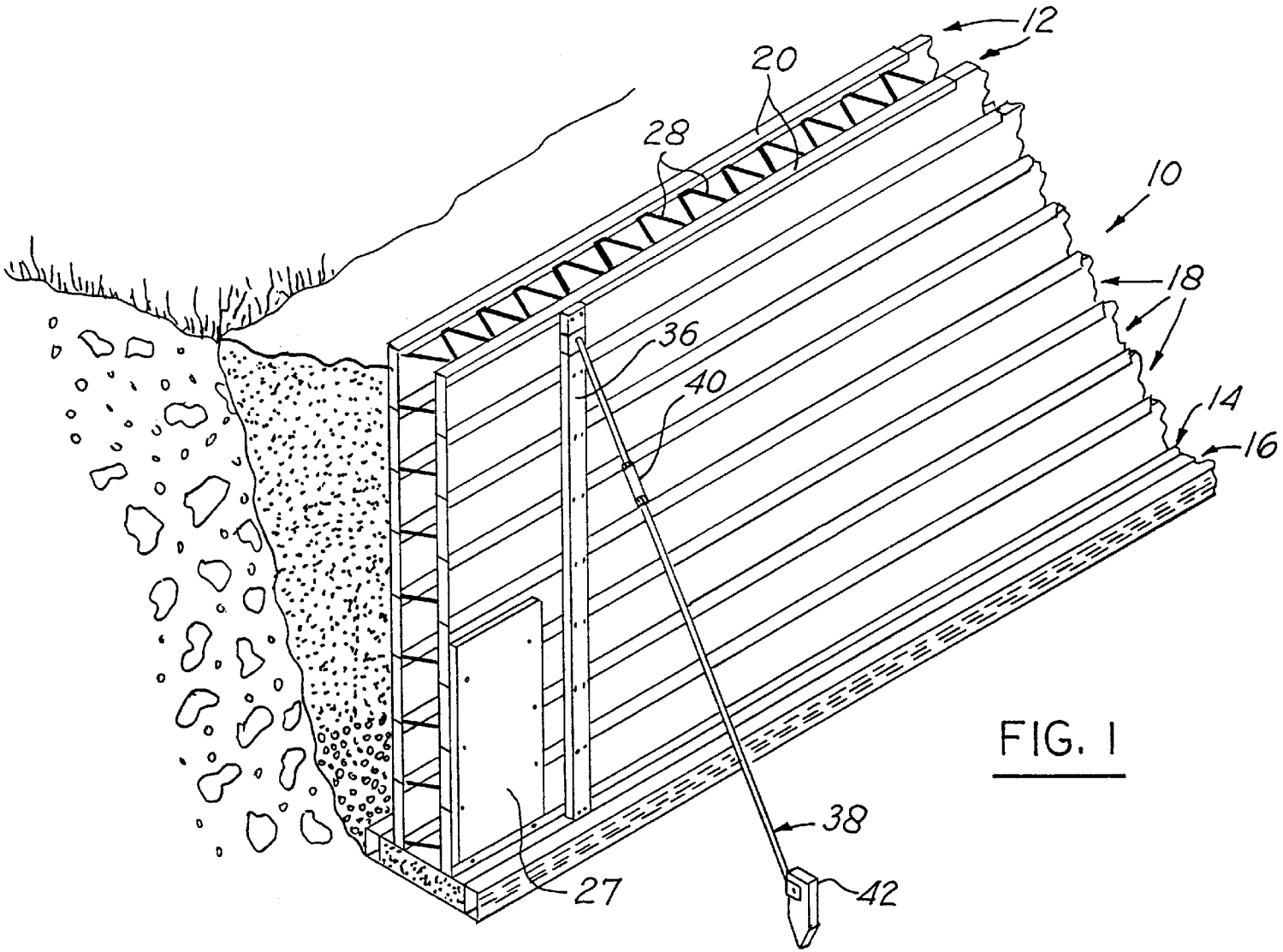
FIG. 1 is a perspective view of a form system and apparatus constructed in accordance with one form of the invention.
Figure 2:
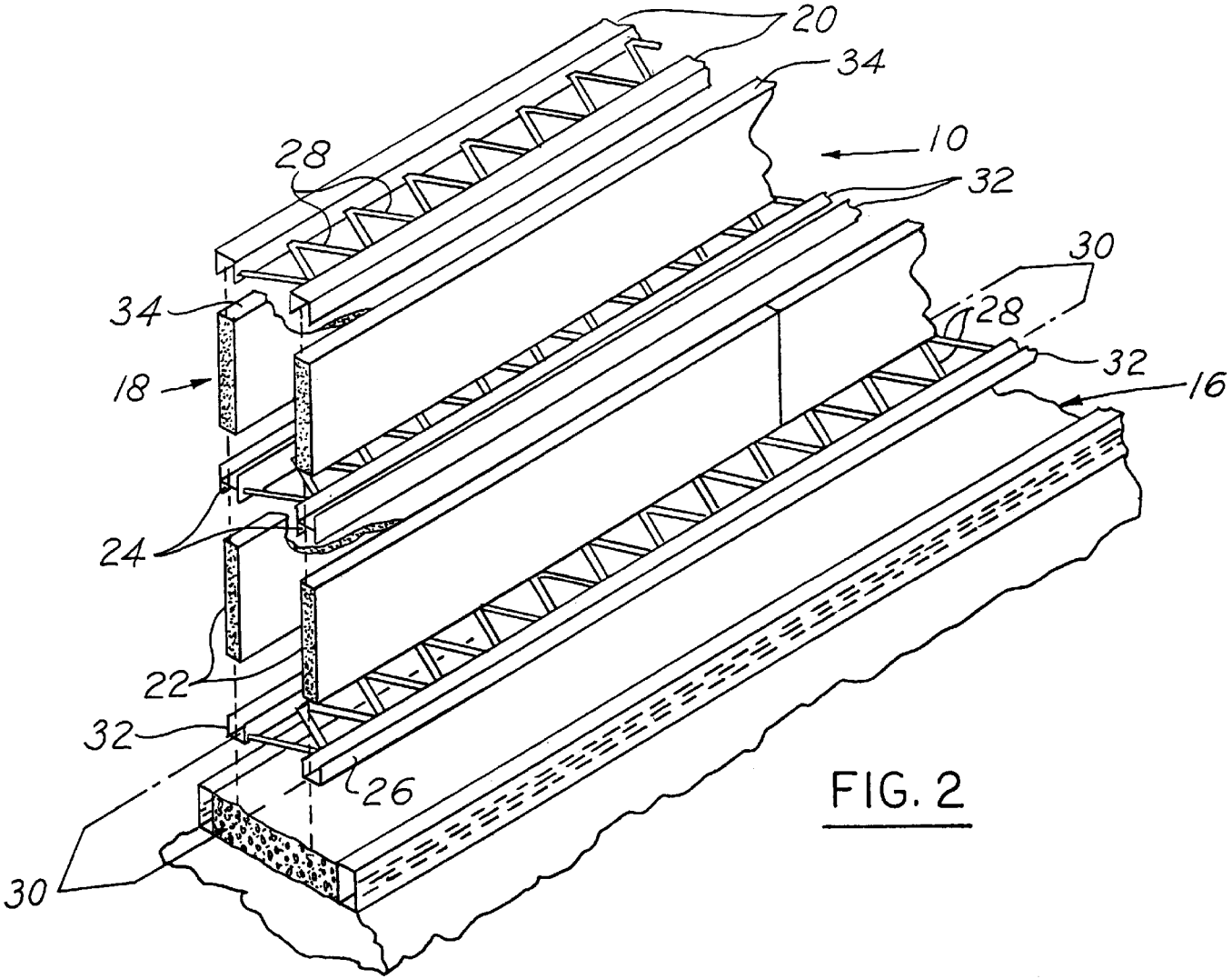
FIG. 2 is an exploded perspective view of the form system and apparatus shown in FIG. 1.

Referring to the drawings, a building form system and apparatus is shown in FIG. 1 at 10. The form system and apparatus is useful in construction and provides a form or mold for retaining concrete or other similar building materials until they harden to form a structural panel, foundation or the like. The form system 10 provides two spaced parallel panels 12 between which concrete can be poured to form a structural member. In one illustrated embodiment, the form system 10 comprises a bottom assembly 14 set on a footing 16, a plurality of panel assemblies 18 stacked thereon, and a top cap 20 placed on the top of a stack of the panel assemblies 18 as shown in FIGS. 1 and 2. The panel assemblies 18 preferably include panels 22 formed of a rigid, lightweight, inexpensive material such as expanded or extruded polymer foam inserted into H-shaped elongated members 24 that allow stacking of the panels 22. The panels 22 and the components in which they are inserted preferably have substantially planar surfaces. This enables widely available polymer foam materials to be used for the panels 22. Furthermore, the components can be easily and inexpensively extruded due to this planar design.

Figure 3A:
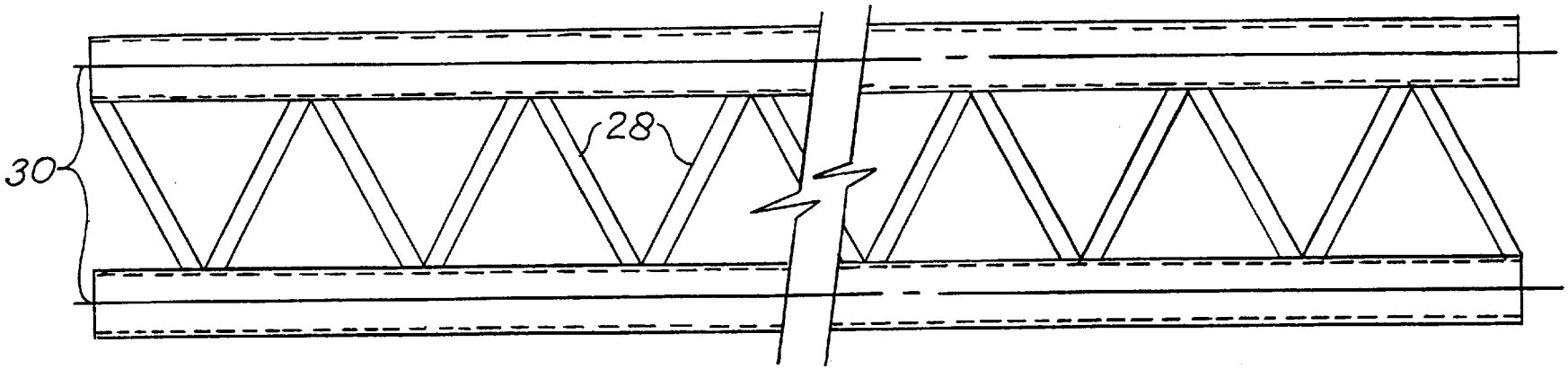
FIG. 3A is a bottom view of U-shaped bottom members connected by links.
Figure 3B:
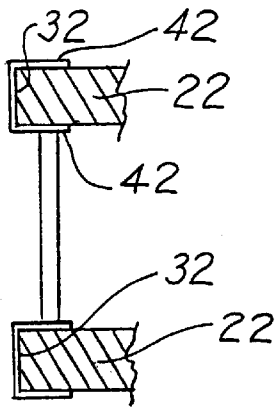
FIG. 3B is an end view of the members and links shown in FIG. 3A.
Figure 4A:
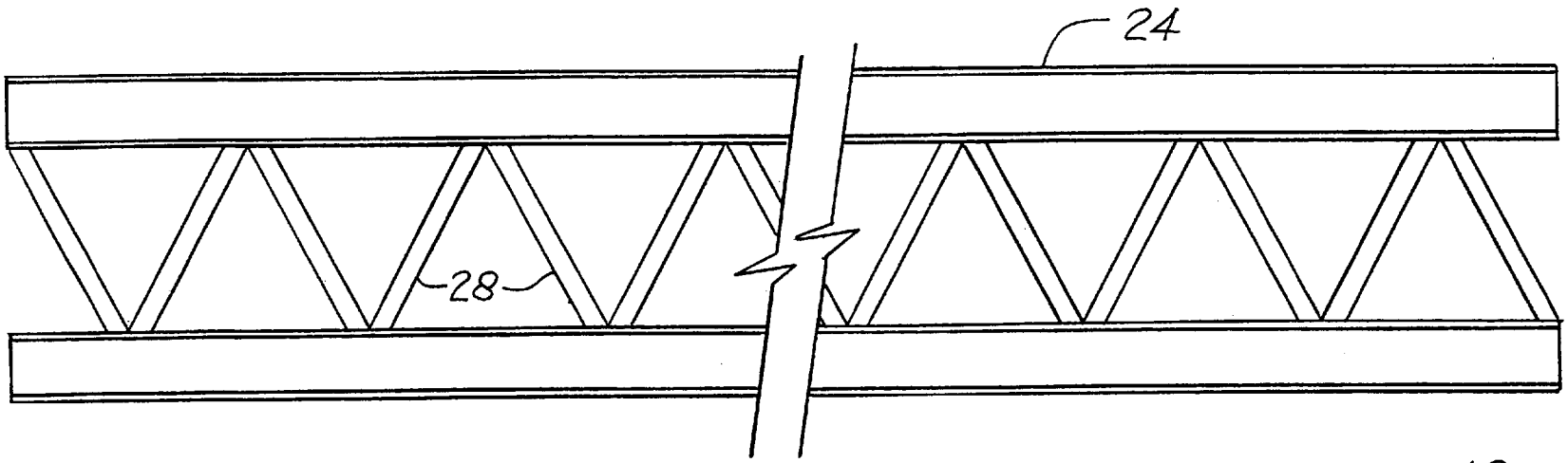
FIG. 4A is a top view of H-shaped members connected by links at acute angles.
Figure 4B:
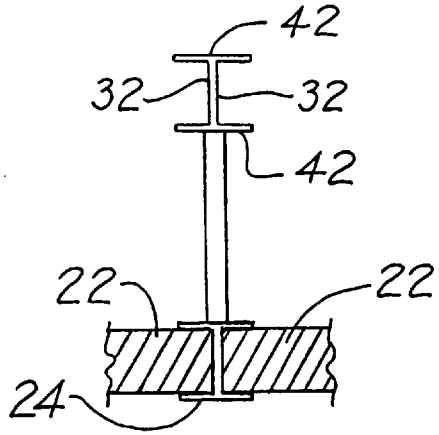
FIG. 4B is an end view of the members and links shown in FIG. 4A.
Figure 4C:
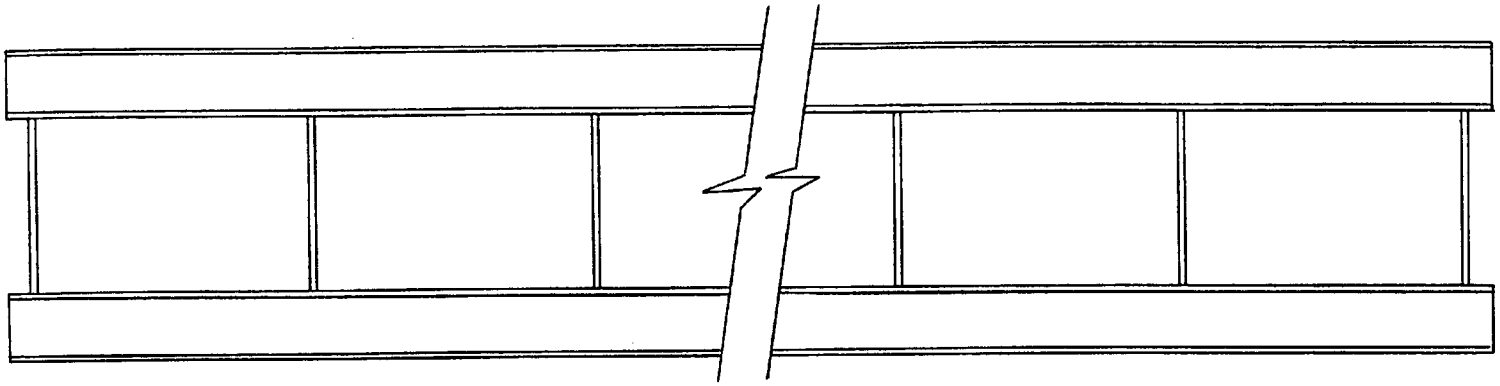
FIG. 4C is a top view of H-shaped members connected by links at ninety degree angles in accordance with a most preferred embodiment of the invention.
Figure 4D:
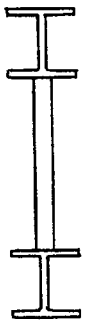
FIG. 4D is an end view of the members and links shown in FIG. 4C.

The bottom assembly 14 comprises two substantially U-shaped elongated members 26 connected by rigid links 28, as shown in FIGS. 2, 3A and 3B. In the most preferred embodiments, the top cap 20 is identical to the U-shaped elongated members 26. The links 28 are illustrated connected at acute angles along longitudinal axes 30 of the substantially U-shaped elongated members 26 as shown in FIG. 3A. However, the links 28 can be connected to the U-shaped elongated members 26, the H-shaped elongated members 24 (e.g., FIG. 4C) and top cap 29 at ninety degree angles which is a most highly preferred embodiment. The links 28 retain the panels 22 in a spaced-apart relationship to allow flow of the hardenable liquid building material (e.g., concrete) between the panels 22 and the U-shaped elongated members 26. Further, connecting the links 28 at ninety degree or acute angles prevents longitudinal shifting as well as compression or expansion of the spaced-apart relationship of the panels 22. This ensures the dimensional integrity of the resulting structure.

The panels 22 are received into channels 32 of the U-shaped elongated members 26 as shown in FIGS. 1, 2 and 3B. While various dimensions can be used, it has been found that a depth of 1.5 inches and a width of 2.5 inches for the U-shaped elongated members 26 works satisfactorily. An exemplary spacing between the U-shaped elongated members 26 is 7.62 inches.

After the panels 22 are placed into the channels 32 of the U-shaped elongated members 26 coupled by the links 28, a substantially H-shaped elongated member 24 is placed on top of each of the panels 22 as shown in FIGS. 1, 2, 4A, 4B, 4C and 4D. Next, panels 22 are placed into the channels 32 of the H-shaped elongated members 24. It will be recognized that slots can be cut into the panels 22 into which portions (such as the flanges 42) of the H-shaped elongated members 24 and U-shaped elongated members 26 can be inserted. Stacking of the H-shaped elongated members 24 and the panels 22 can be repeated until a desired wall height is achieved as shown in FIG. 2. Further, the panels 22 can be easily cut to provide virtually any structure height desired. This is a distinct advantage over prior art systems which have typically required labor intensive operations to produce nonstandard structure heights.

Figure 5:
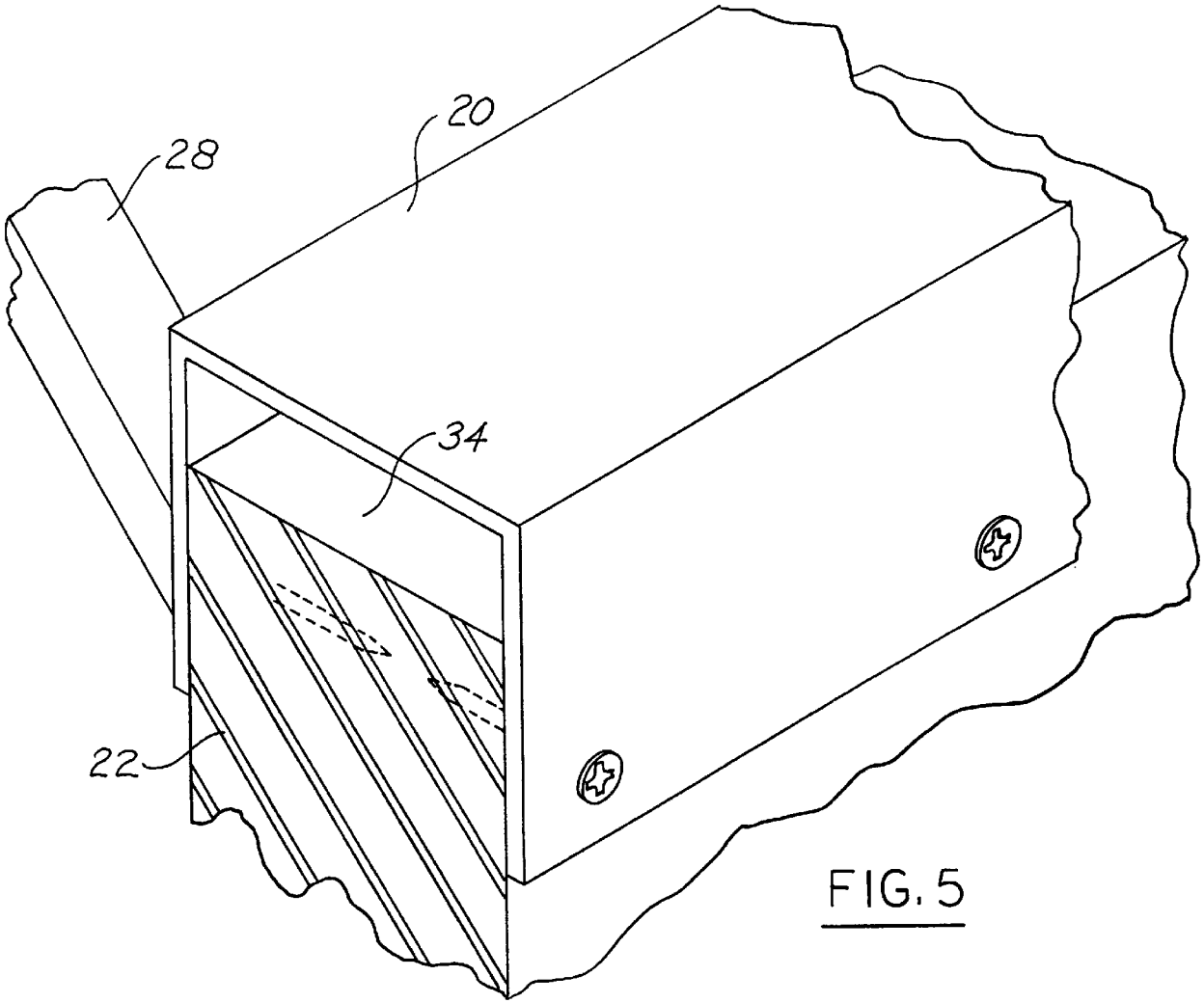
FIG. 5 is a perspective view of a top cap used to level the top of a panel structure formed by the invention.

A top cap 20 is placed over the upper edge 34 of the uppermost panel 22 as shown in FIGS. 2 and 5. If the upper edge 34 is not level, the top cap 20 can be fixed in place using drywall screws or other conventional means once it has been pivoted into a level configuration. In this way, the top surface of the resulting structure can quickly be made perfectly level, without requiring a complicated and labor-intensive process.

As shown in FIG. 1, the stacked panel assemblies 18 are braced on one side by a channel 36 connected to the panel assemblies 18 through use of drywall screws or other conventional means. The channel 36 is maintained in a desired configuration using a threaded steel rod mechanism 38 having a turnbuckle 40 disposed at its center. One end of the steel rod mechanism 38 is attached to the channel 36 and the other end of the steel rod mechanism 38 is connected to a post 42 driven into the ground. The panel assemblies 18 can be aligned at ninety degrees (plumb to the footing 16) by adjusting the post 42 and steel rod mechanism 38 accordingly.

Because the stacked panel assemblies 18 require bracing only on one side, workers never have to go outside the sections to work on the panel assemblies 18. This enables substantial reduction of the conventional four-foot working space which is typically dug outside foundation walls. With the present invention, this clearance space can be reduced to one foot or even less. Accordingly, much less backfilling is required. Ideally, backfilling is accomplished using sand so that drainage around the foundation is enhanced. However, using conventional systems requiring the four-foot working space, contractors often are reluctant to fill this entire space with sand due to the costs of such large quantities of sand. The substantially reduced backfilling far required by the present invention makes use of sand for backfilling far more cost effective.

The panel assemblies 18 are strong enough to allow the desired sand backfilling operations of the present invention to take place before concrete or other hardenable liquid building materials are poured into the system 10. This unusual strength enables greater flexibility in scheduling the backfilling operation, thereby expediting the construction process and lowering costs. Once all sections have been assembled and the top caps 20 have been leveled, hardenable liquid building material (preferably concrete) can be poured into the spaces between the top caps 20, panels 22, H-shaped elongated members 24 and the U-shaped elongated members 26. After the concrete hardens, a solid structure is formed. The invention allows drywall 27 or other building material to be connected to the panel assemblies 18 using drywall screws or other conventional means penetrating the flanges 42 of the H-shaped elongated members 24, U-shaped elongated members 26, as shown in FIG. 1. The drywall 27 can also be connected to the top cap 20 in an identical fashion.

While the members described herein can be formed from a variety of materials such as steel and plastic, preferably steel or extruded plastic are used depending on the availability and material cost of each in a specific region. The extruded plastic design allows relatively long members to be formed without expensive tooling required for injection molded designs. Even with these longer members, it may still be desirable to splice sections of assembled wall assemblies together as shown in FIGS. 6A–6C and 7.

Figure 6A:
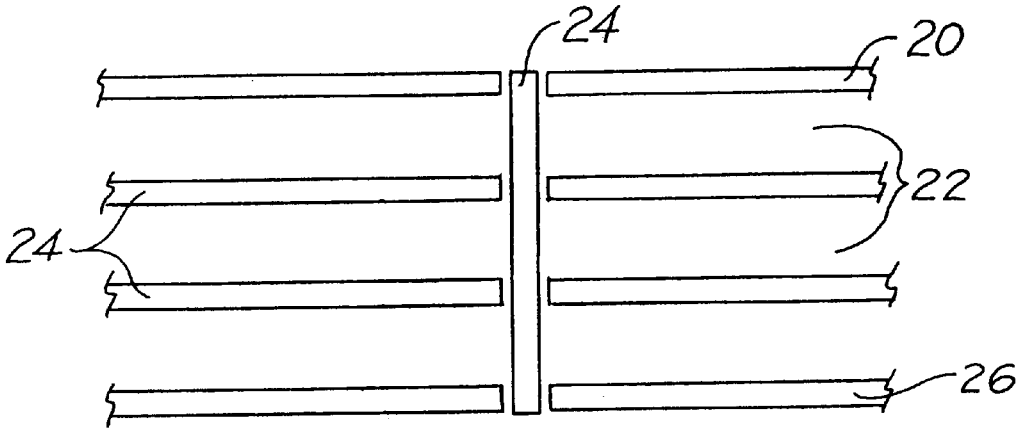
FIG. 6A is a side view of a section splice.
Figure 6B:
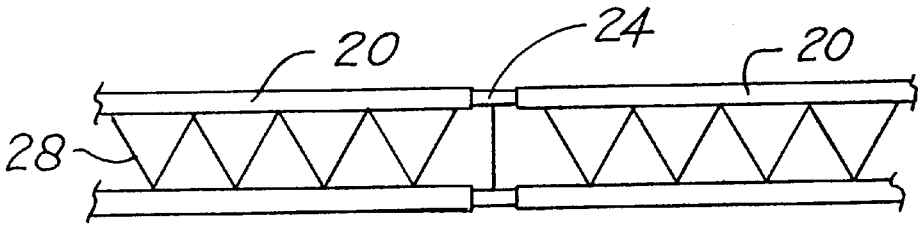
FIG. 6B is a top view of the splice shown in FIG. 6A
Figure 6C:
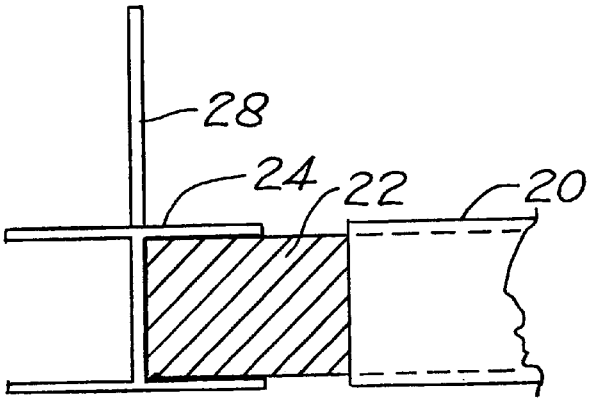
FIG. 6C is an enlarged sectional view of the splice shown in FIG. 6B.
Figure 7:
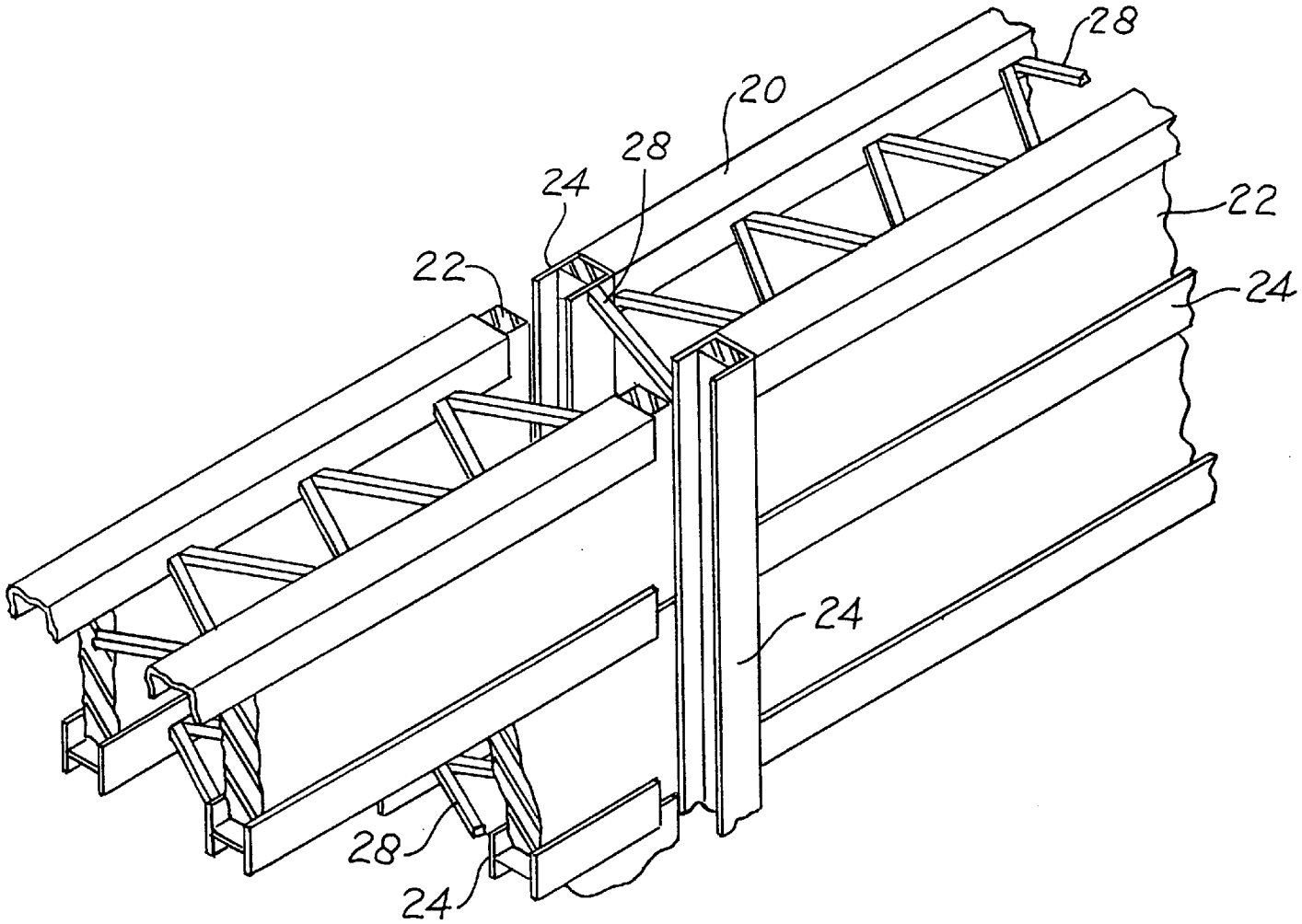
FIG. 7 is an enlarged and exploded perspective view of the splice (of two sections of assembled panel structures) shown in FIG. 6B.

The present invention does not require special, complex pieces for the splicing operation. Instead, an H-shaped elongated member 24 is placed vertically and abuts the H-shaped elongated members 24, the panels 22 and the U-shaped elongated members 26 from each section to be joined. The vertical H-shaped elongated member is connected to the various members using conventional means such as drywall screws. Next, the top cap 20 is placed over the assembled sections as shown in FIGS. 6C and 7. In this way, a secure connection is easily and quickly obtained.

Figure 8:
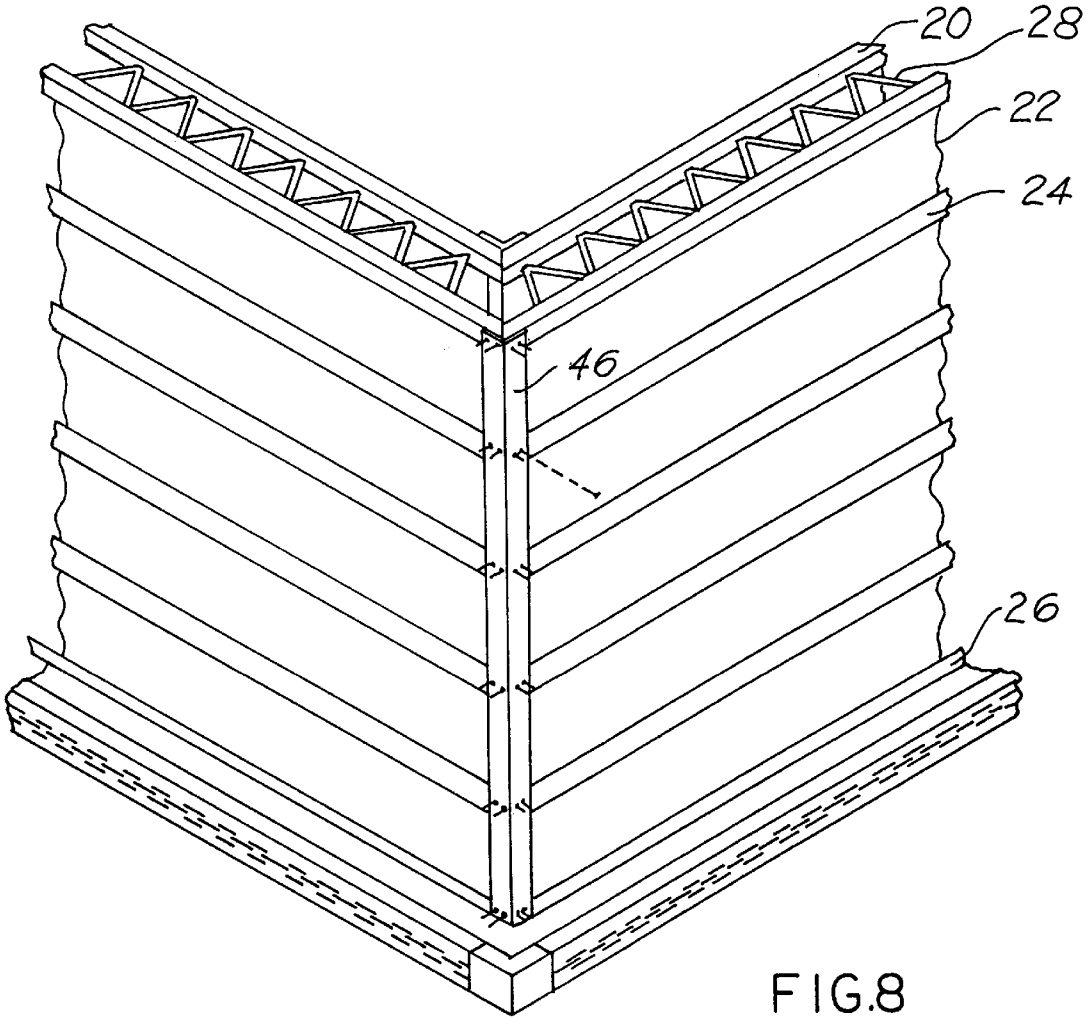
FIG. 8 is a perspective view of a ninety degree outside corner formed using one form of the present invention.

FIG. 8 shows a method of constructing a ninety degree outside corner. As illustrated, stacked assemblies are connected using two ninety degree angle pieces 46 connected to top caps 20, panels 22, H-shaped elongated members 24 and U-shaped elongated members 26 cut at forty-five degree angles. The angle pieces 46 are connected to the various members using conventional means such as drywall screws as shown in FIG. 8.

Figure 9:
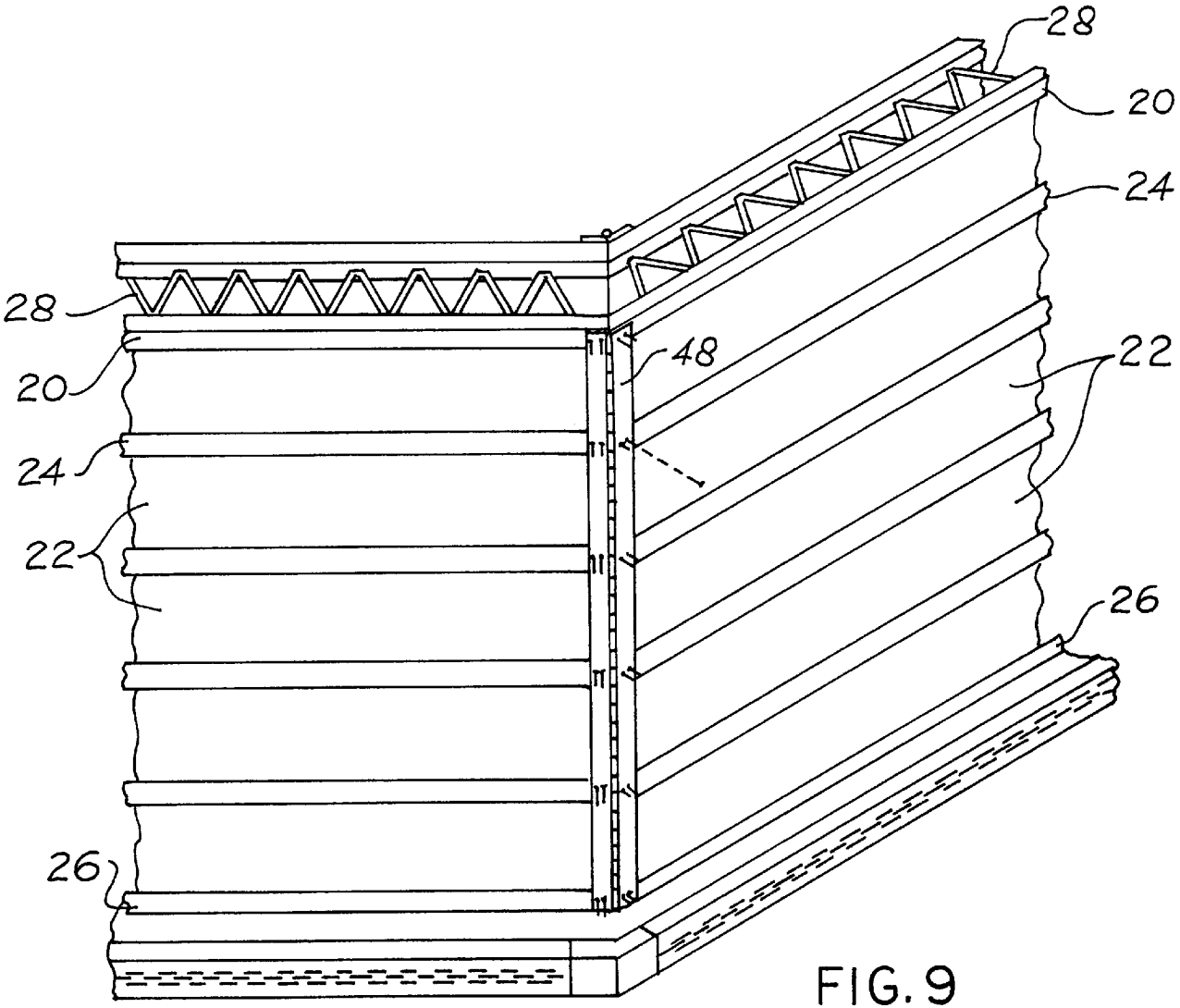
FIG. 9 is a perspective view of a forty-five degree outside corner formed in accordance with one form of the present invention.

FIG. 9 illustrates a forty-five degree outside corner constructed using one form of the present invention. In this case, the sections are cut at a twenty-two-and-one-half degree angle, and piano hinge members 48 are coupled to the sections to retain them in place.

Figure 10:
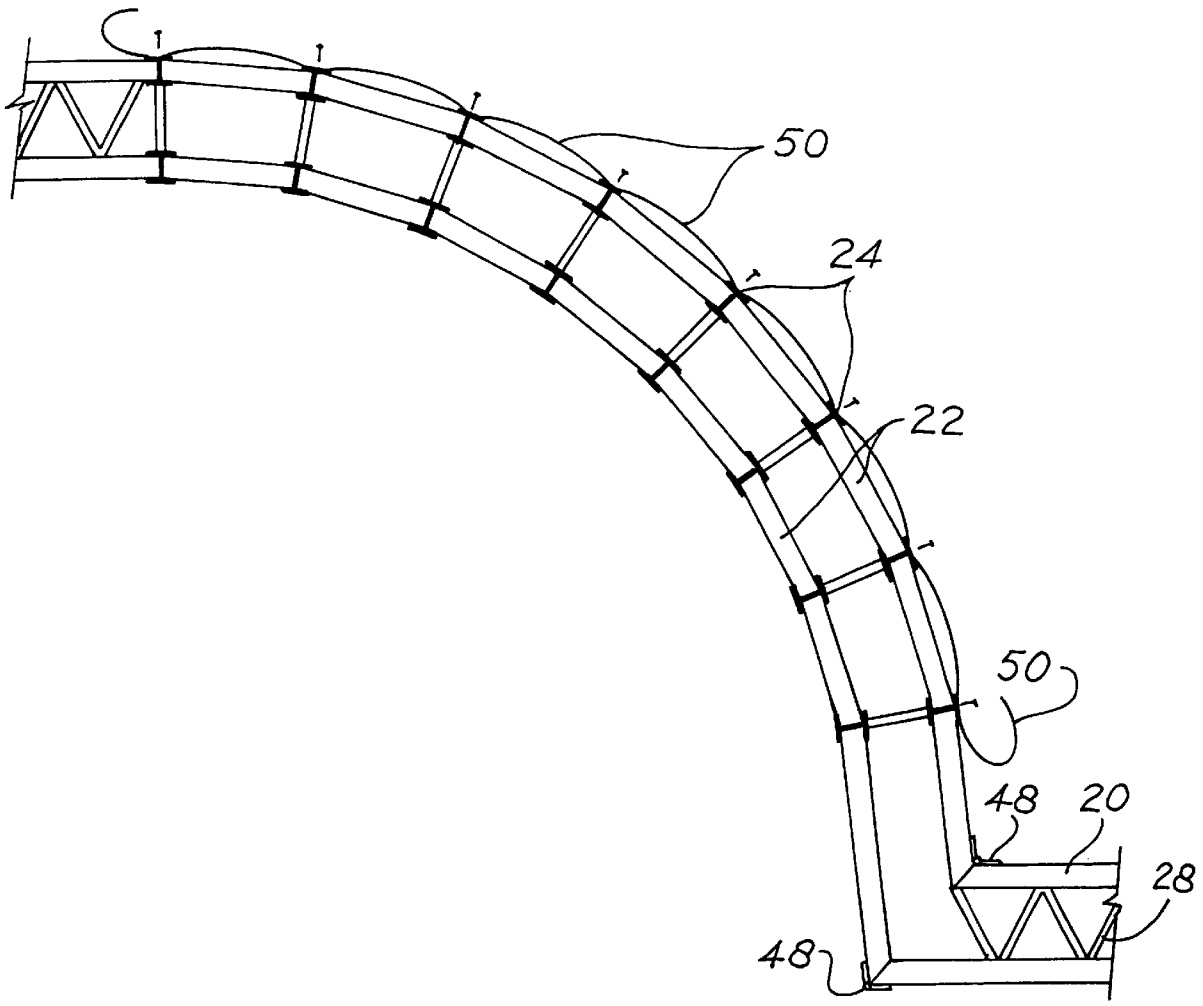
FIG. 10 is a top view of a wall form system for producing a curved panel.

The invention can also be used to form curved walls as shown in FIG. 10. In this embodiment, the beginning of the curved wall is connected to a standard section using piano hinge members 48 connected using conventional means such as drywall screws to a section abutting the curved section. The curved section comprises substantially H-shaped elongated members 24 in vertical orientation, similar to the splicing method described hereinbefore, along with narrower wall panels 22 for the inner portion of the curve section and wider panels 22 for the outer section. The entire assembly can be held together using conventional perforated metal strapping 50 or other conventional retention means as shown in FIG. 10.

Figure 11:
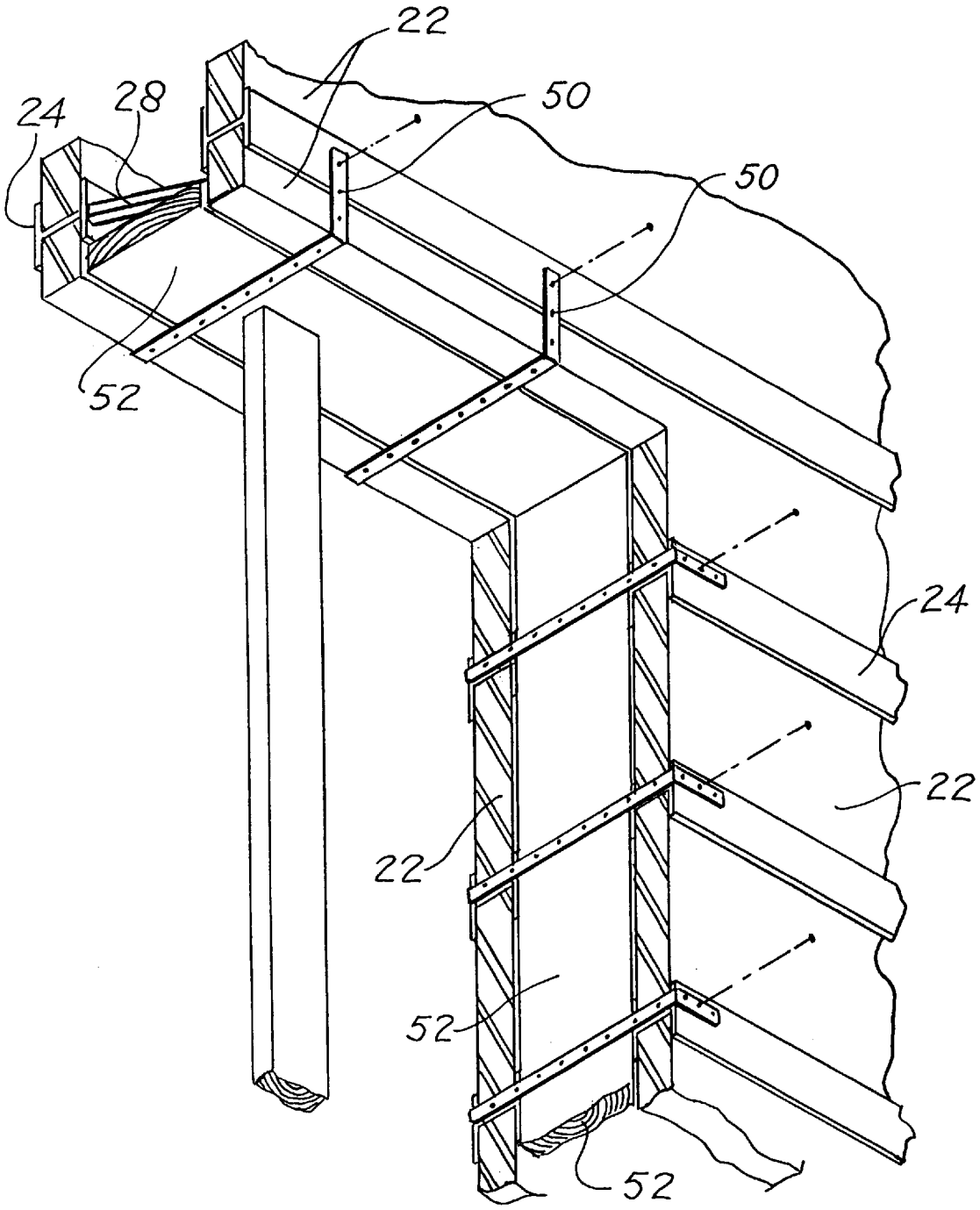
FIG. 11 is a perspective view of one form of the invention useful for framing a door or window opening.
Figure 12:
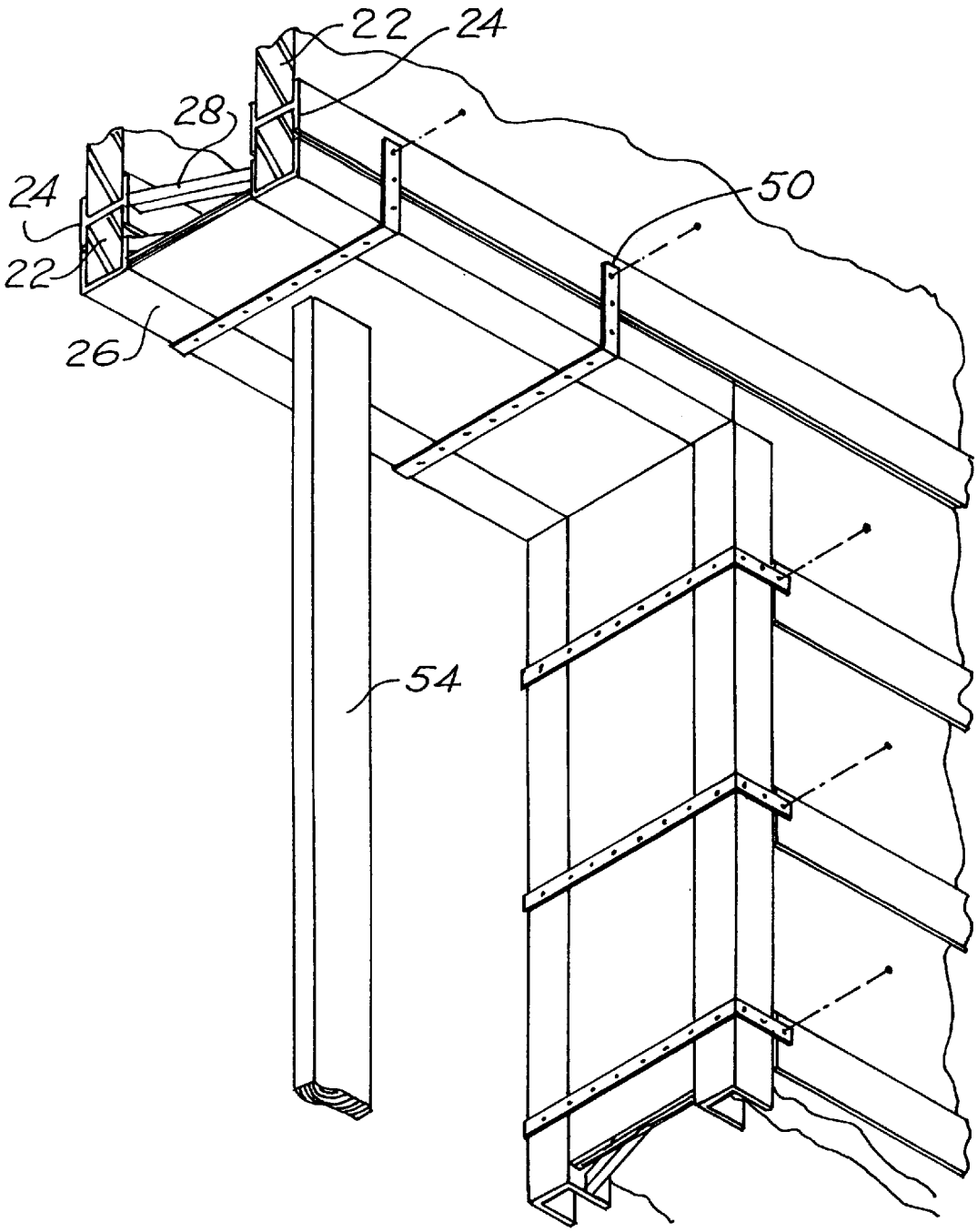
FIG. 12 is a perspective view of an alternative embodiment of one form of the invention useful for framing a door or window opening.
Figure 13:
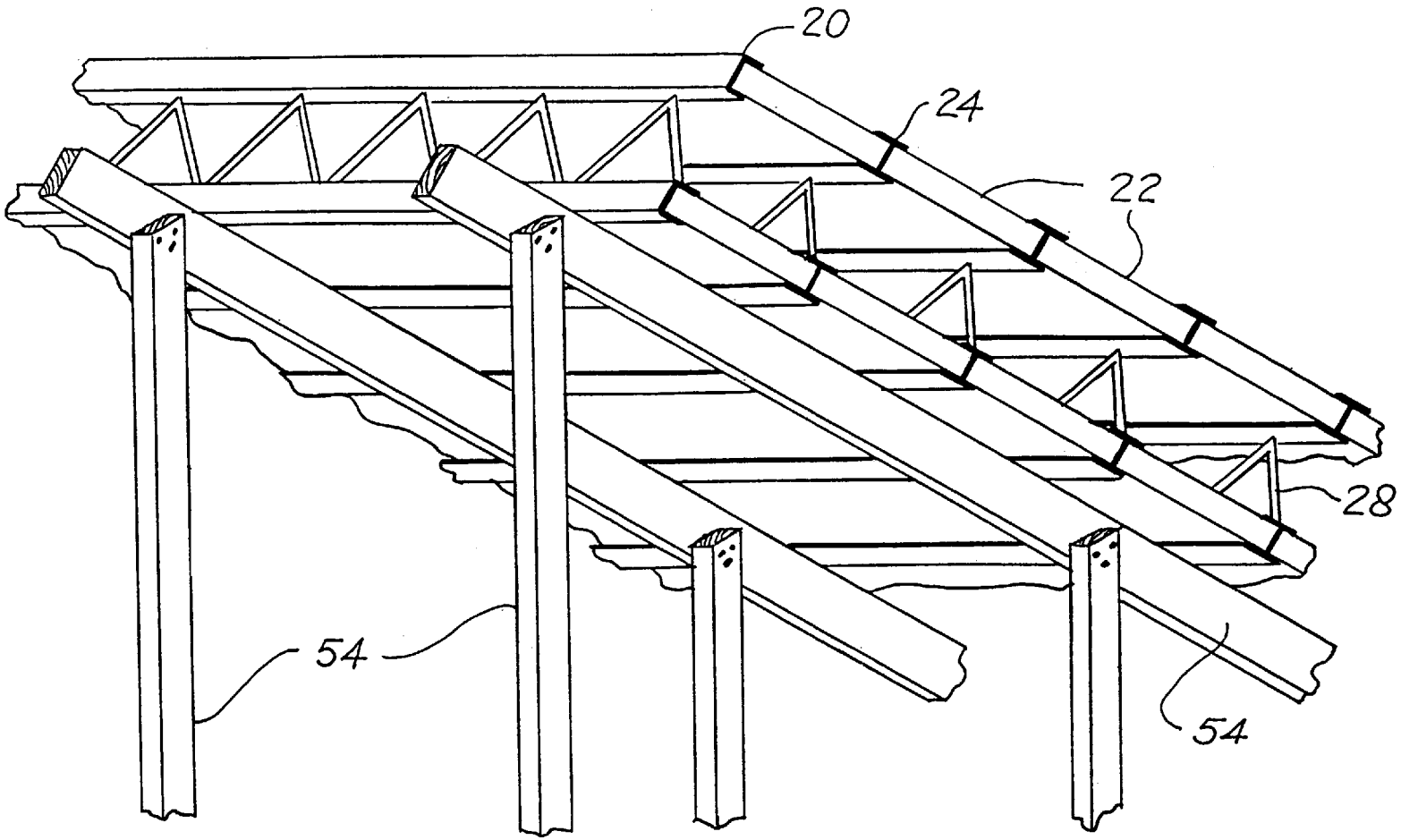
FIG. 13 is an end view of a roof application of one form of the invention.

FIGS. 11–13 show alternative embodiments of the invention, wherein lumber 52 can be held in place by conventional metal perforated strapping 50 to form an end seal, or top or bottom seal for various sections as described hereinbefore. FIG. 13 illustrates how the form system 10 can be braced for forming sections other than those that are strictly vertical merely by using sufficient bracing 54 to hold the system in place. In this way, an entire building structure can be produced using the present invention.

Figure 14:
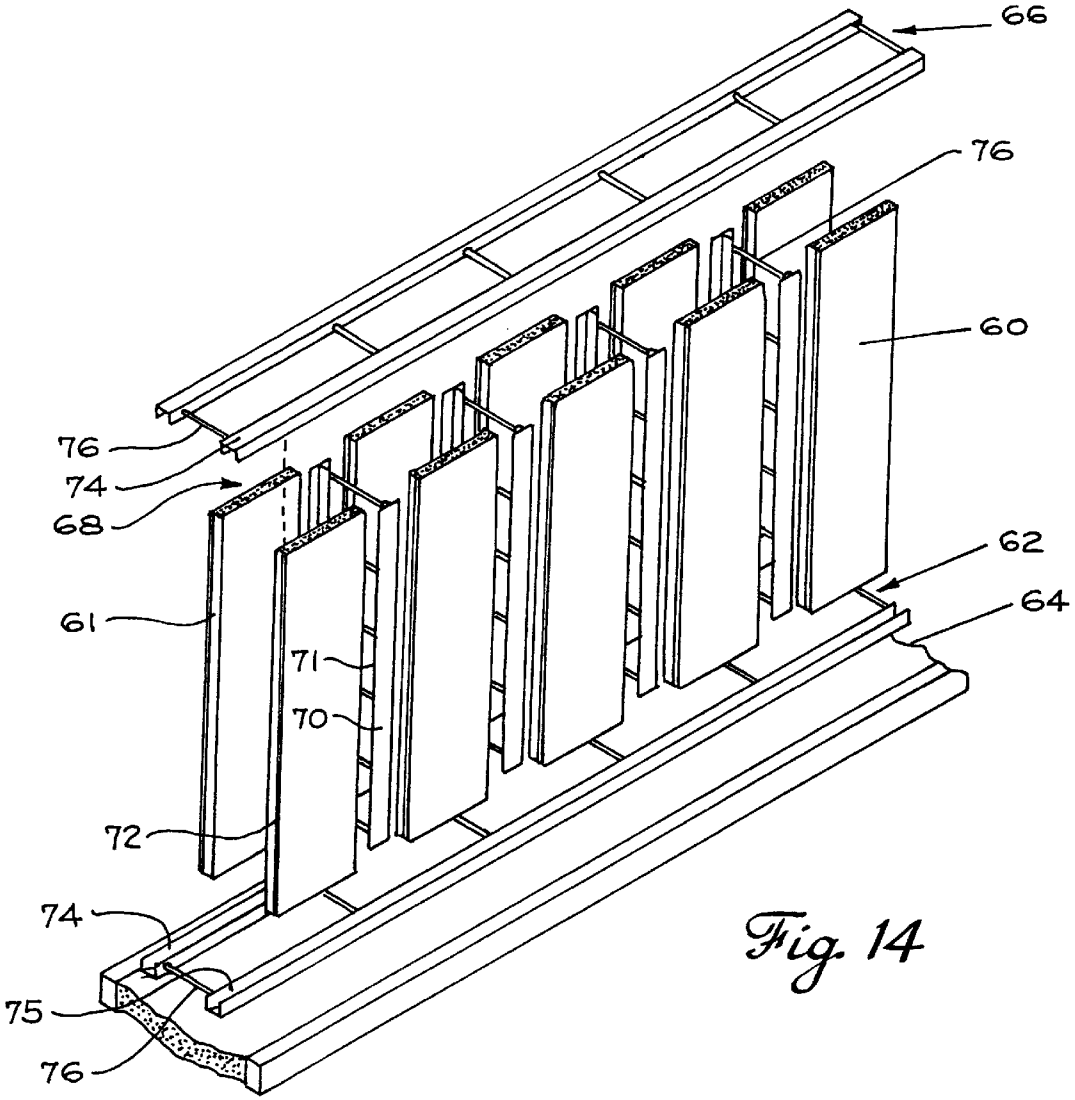
FIG. 14 is an exploded perspective view of a vertically oriented building form system and apparatus constructed in accordance with one form of the invention.

A building form system and apparatus constructed in accordance with another preferred embodiment of the invention is shown in FIG. 14. The form system 10 provides two spaced, substantially parallel and substantially vertically oriented panels 60 between which concrete or other building material can be poured to form a structural member, in virtually the same manner as the curved wall construction shown in FIG. 10. The form system 10 preferably comprises a bottom assembly 62 set on a footing 64, a plurality of vertically oriented panels 60 aligned thereon, and a top cap 66 placed on the top of a line of panel assemblies 68 as shown in FIG. 14. The panel assemblies 68 preferably include panels 60 formed of a rigid, lightweight, inexpensive material such as expanded or extruded polymer foam connected by T-shaped elongated members 70 that can align the panels 60. The panels 60 can include one or more slots 72, sawn, milled or otherwise formed in the panel 60, such that a flange 71 of the T-shaped member 70 fits into the slot 72 in the lateral edge of the panel 60.

The bottom assembly 62 comprises two substantially U-shaped elongated members 74 connected by rigid links 76. In the most preferred embodiments, the top cap 66 is identical to the bottom assembly 62 but is installed in an inverted orientation. The links 76 can be connected at acute angles along the longitudinal axes of the substantially U-shaped elongated members 74. However, as illustrated, the links 76 are preferably connected to the U-shaped elongated members 74 and the T-shaped elongated members 70 at ninety degree angles. The links 76 retain the panels 60 in a spaced-apart relationship to allow flow of the hardenable liquid building material (e.g., concrete) between the panels 60 and the U-shaped elongated members 74. Further, connecting the links 76 at ninety degree or acute angles prevent longitudinal shifting as well as compression or expansion of the spaced-apart relationship of the panels 60. This ensures the dimensional integrity of the resulting structure.

After the panels 60 are placed into the channels of the U-shaped elongated members 74 coupled by the links 76, a substantially T-shaped elongated member 70 is placed into the slot 72 located on a lateral edge 61 of each of the panels 60 as shown in FIG. 14. The bottom edge of the T-shaped member 70 is placed into the channel 75 of the U-shaped member 74. The next panel 60 is aligned with the panel 60 already in place and attached to the panel 60 by inserting the flanges 71 of the T-shaped member 70 into the slot 72 in the lateral edge 61 of the panel 60. This construction method can be repeated, as shown in FIG. 14, until a desired structure length is achieved. Further, the panels 60 can be easily cut to provide virtually any structure height desired. This is a distinct advantage over prior art systems which have typically required labor-intensive operations to produce non-standard structure heights. The panels 60 can be easily raised and lowered along the tracks created by the flanges 71 of the T-shaped members 70 in order to install fixtures or other components between the interior and exterior panel assembles 86 as shown in FIG. 18.

The top cap 66 is placed over the top edge of the aligned panels 60 as shown in FIG. 14. If the aligned top edges are not level, the top cap 66 can be fixed in place using drywall screws or other conventional means once it has been pivoted into a level configuration. In this way, the top surface of the resulting structure can quickly be made perfectly level, without requiring a complicated and labor-intensive process. In this embodiment, the U-shaped channel members 74 that form the top cap 66 are interconnected by rigid members 76. However, the U-shaped members 74 that form the bottom assembly 62, as well as the U-shaped members that form the top cap 66, do not have to be coupled together by links 76. However, the members 74 which form the inner and outer channels 75 of the bottom assembly 62 are secured individually to the footing 64, and the U-shaped members that form the inner and outer channels for the top cap 66, although independent of one another, are fixed in place using drywall screws or other conventional fasteners.

Figure 18:
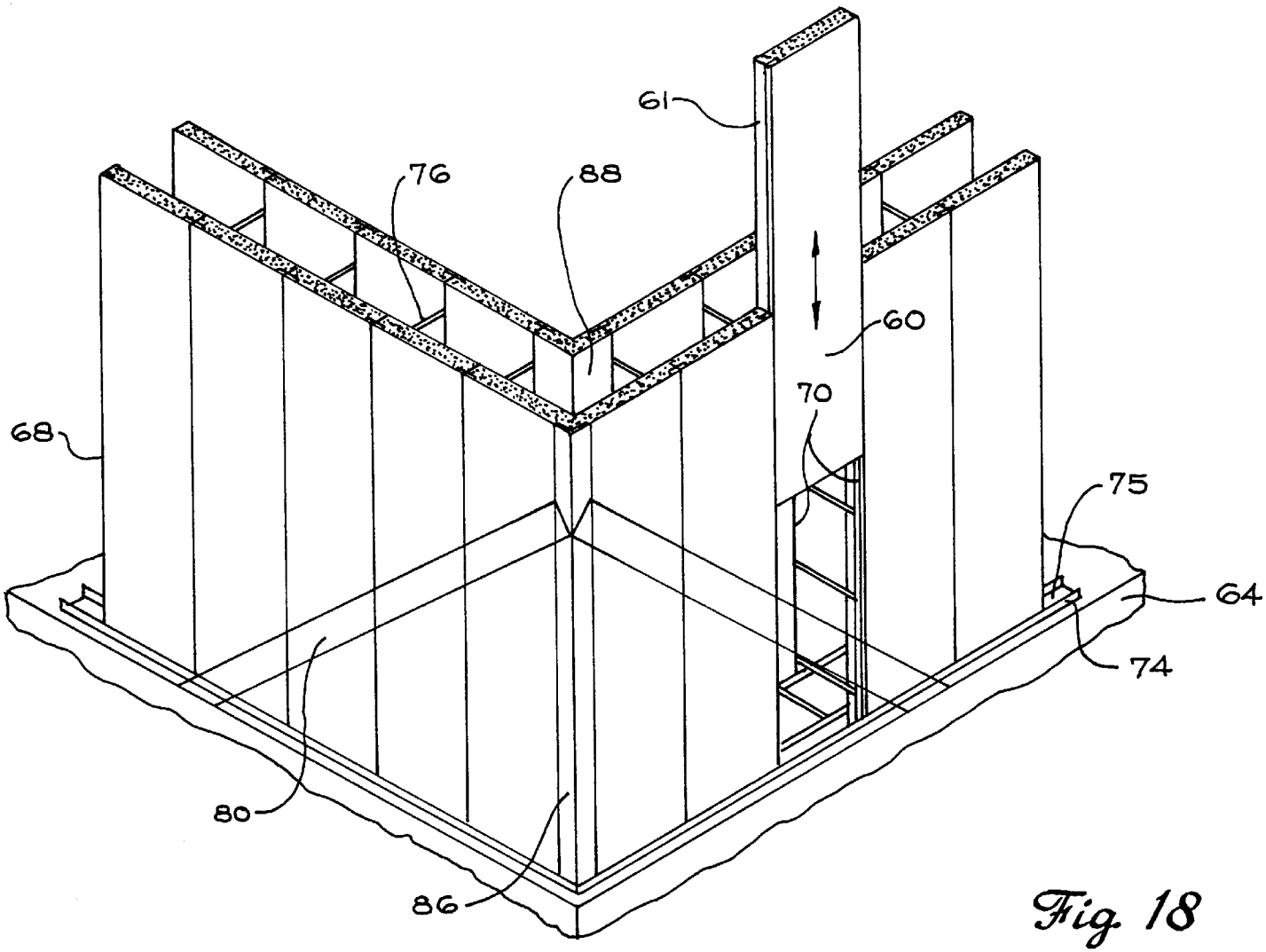
FIG. 18 is a perspective view of a vertically oriented building form system showing a method by which a panel can be raised and lowered prior to liquid building material being poured into the system.

The building form system can be braced as shown in FIG. 18. Because the aligned panel assemblies 68 require bracing 80 only at the corners of the form system and the bracing 80 runs parallel to the form system, a significant amount of work effort and material is saved compared to prior art form systems which require vertical bracing at regular intervals to keep the panel assemblies 68 plumb and to prevent horizontal bulging. In addition, workers have limited functions to perform outside the panel assembly 68. This enables a substantial reduction in the conventional four-foot working space typically dug outside foundation walls. Accordingly, much less backfilling is required. The panel assemblies 68 are strong enough to allow the desired backfilling operations of the present invention to take place before concrete or other hardenable liquid building materials are poured into the system. This unusual strength enables greater flexibility in scheduling the backfilling operation, thereby expediting the construction process and lowering costs.

Once all sections have been assembled as shown in FIG. 14 and the top caps 66 have been leveled, hardenable liquid building material (preferably concrete) can be poured into the spaces between the top caps 66, panels 60, T-shaped elongated members 70 and the U-shaped elongated members 74. After the concrete hardens, a solid structure is formed. The invention allows drywall or other building material to be connected to the panel assemblies 68 using drywall screws or other conventional means penetrating the flanges of the T-shaped elongated members 70 or U-shaped elongated members 74. The drywall can also be connected to the top cap 66 in an identical fashion.

While the members described herein can be formed from a variety of materials such as steel and plastic, preferably steel or extruded plastic are used depending on the availability and material cost of each in a specific region. The extruded plastic design allows relatively long members to be formed without expensive tooling required for injection molded designs. Although vertical members are available in lengths of up to sixteen feet or more, it may still be desirable to splice sections of assembled wall assemblies together to create assemblies of greater height.

The present invention does not require special, complex pieces for the splicing operation. Instead, an H-shaped elongated member 24 can be placed horizontally across the top ends of the vertical panels 60 and T-shaped members 70. The horizontal H-shaped elongated member 24 is connected to the various members using conventional means such as drywall screws. The next level of vertically aligned panels 60 and T-shaped members 70 are inserted into the upwardly directed channel of the H-shaped member 24. Finally, the top cap 66 is placed over the assembled sections. In this way, a secure connection is easily and quickly obtained.

FIGS. 15 and 16A–16E show a method for constructing a ninety degree outside corner. U-shaped members 74 coupled by substantially rigid links 76 are cut at forty-five degree angles at the ends and coupled to a footing 64 at a right angle to similar U-shaped members 74. To form the outer alignment of the corner assembly 82, the bottom edge of a corner post 86 is inserted in a substantially vertical orientation into the channel 75 of the outer U-shaped member 74. The bottom edge of a T-shaped member 70 in a substantially vertical orientation is inserted into the channel 75 of the outer U-shaped member 74 and the flange 71 of the T-shaped member is inserted into a slot in the lateral edge of the corner post 86. The bottom edge of a substantially vertically oriented panel 60 is inserted into the channel 75 of the outer U-shaped member 74 and the panel 60 is coupled to the corner post 86 by inserting the flange 71 of the T-shaped member 70 into a slot 72 in the lateral edge 61 of the panel 60. The corner post 86 preferably includes a built in drain tile to accept down spout run off from the roof of the structure and deliver it to a conventional tile in a foundation footing 64.

To form the inner alignment of the corner assembly 84, the bottom edge of a preformed panel 88 in the form of a ninety degree corner is inserted into the channel 75 of the inner U-shaped members 74. The bottom edge of a substantially vertically oriented T-shaped member 70, coupled to an opposite T-shaped member 70 by substantially rigid links 76, is inserted into the channel 75 of the inner U-shaped member 74 and the flange 71 of the T-shaped member is inserted into a slot in the lateral edge of the preformed panel 88. The bottom edge of a substantially vertical panel 60 is inserted into the channel 75 of the inner U-shaped member and coupled to the preformed panel 88 by inserting the flange 71 of the T-shaped member 70 into a slot 72 in the lateral edge 61 of the panel 60. Panels 60 and T-shaped members 70 alternately are inserted into the inner and outer U-shaped members 74 until a structure of the desired length is obtained. While in the exemplary embodiment the invention is described with reference to forming a ninety degree outside corner, it is apparent that corner assemblies can be provided to form corners for wall sections that extend at angles less than ninety degrees and at angles greater than ninety degrees by suitable shaping of the corner elements 86 and 88.

Figure 17A:
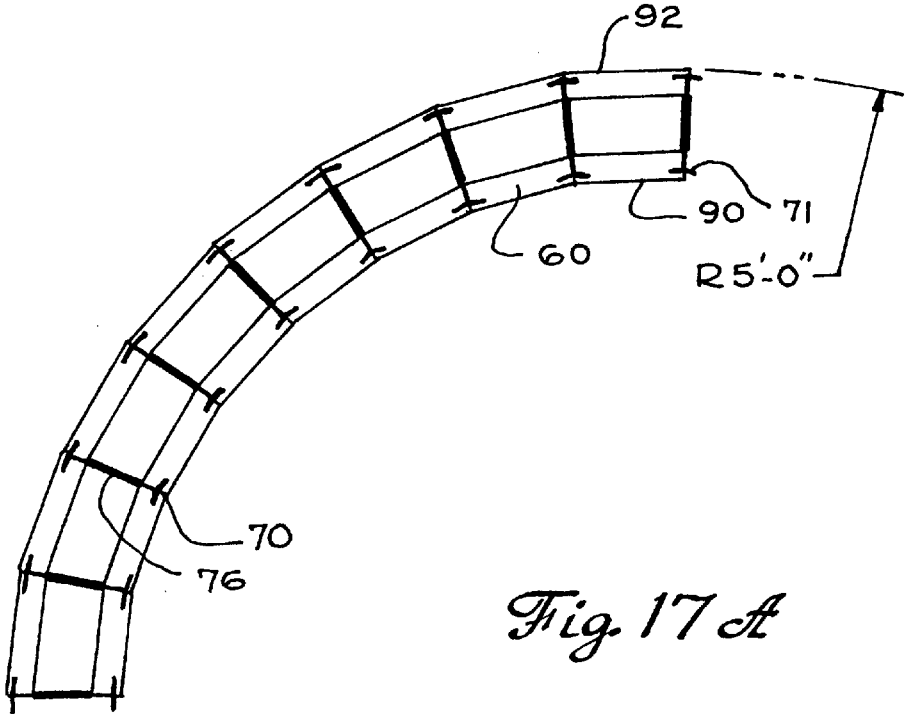
FIG. 17A is a top view of a vertically oriented building form system for producing a curved structure.
Figure 17B:
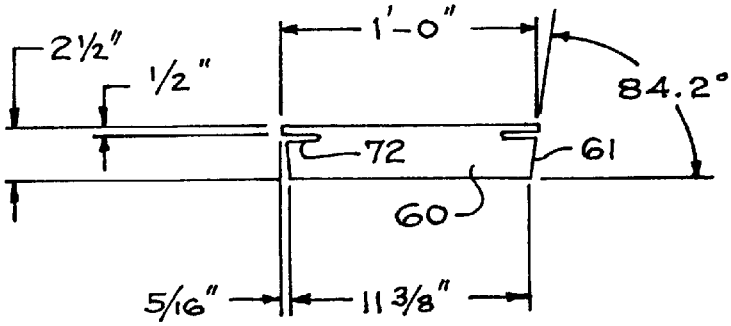
FIG. 17B shows a panel cut and beveled for use with the exterior alignment of the system represented in FIG. 17A.
Figure 17C:
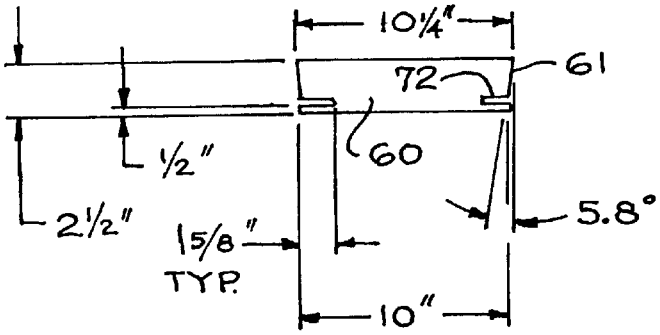
FIG. 17C shows a panel cut and beveled for interior alignment of the system illustrated in FIG. 17A.

The invention can also be used to form curved walls as shown in FIG. 17A. In this embodiment, the curved section comprises standard T-shaped elongated members 70 in a substantially vertical orientation. The T-shaped elongated members 70 are coupled by rigid links 76 that connect narrower panels 60 (as shown in FIG. 17C) in the inner arc of the curve 90 and wider panels 60 (as shown in FIG. 17B) in the outer arc of the curve 92. The panels 60 are beveled at an angle sufficient to allow the lateral edges 61 of said panels 60 to fit tightly together and prevent liquid building material leakage.

In another alternative embodiment of the invention, substantially vertically oriented H-shaped elongated members 24 are substituted for the T-shaped members 70. The bottom edge of the H-shaped member 24 is inserted into and contained within the channel of the U-shaped member 74. Alternatively, the panels 60 are aligned and connected by inserting the flanges of the H-shaped members 24 into slots in the lateral edges 61 of the panels 60 on either side of said member. In another embodiment, the panels are aligned and connected by inserting the lateral edges 61 of the panels 60 on either side of the H-shaped member 24 into the corresponding channel in the H-shaped member.

Accordingly, the present invention provides the ability to anchor drywall to the resulting structure. This is required by building codes in many areas of the country. Previous systems have typically not provided for this criterion, typically necessitating the use of masonry anchors which are expensive and time-consuming to install. The system of the present invention is simple to use, thereby reducing training costs and enhancing efficiency. Further, a smooth flat surface at the top of the form enables quick and easy cleanup of concrete which spills over the side while pouring from conventional supply means such as a concrete truck. Because this spillover is very common, substantial labor savings can be realized by providing the easy to clean top surface of the present invention.

The invention provides a form system and apparatus that allows the upper surface of the resulting structure to be adjusted to level without complex and/or labor-intensive operations. The present invention also provides a form system and apparatus that utilizes simple corner components that are strong and easy to install, and that requires no special pieces for connecting abutting pieces of the system to one another.

Further, the present invention provides the ability to level the top of a foundation, without requiring special pieces or cutting to attain a level upper surface of the foundation. It also provides a fully adjustable form system and apparatus that can be produced by extruding to increase the length of the components that can be produced over previous injection molded designs and reduces tooling and labor costs accordingly. Finally, the inventors have discovered that a form system and apparatus can be constructed to be strong enough to allow backfilling operations to take place before concrete or other hardenable liquid building material is poured into the form. This enables easier access to the form for filling, and allows the backfilling operation to be scheduled when time and weather permits. This flexibility of operation can further expedite the building process.

Figure 19:
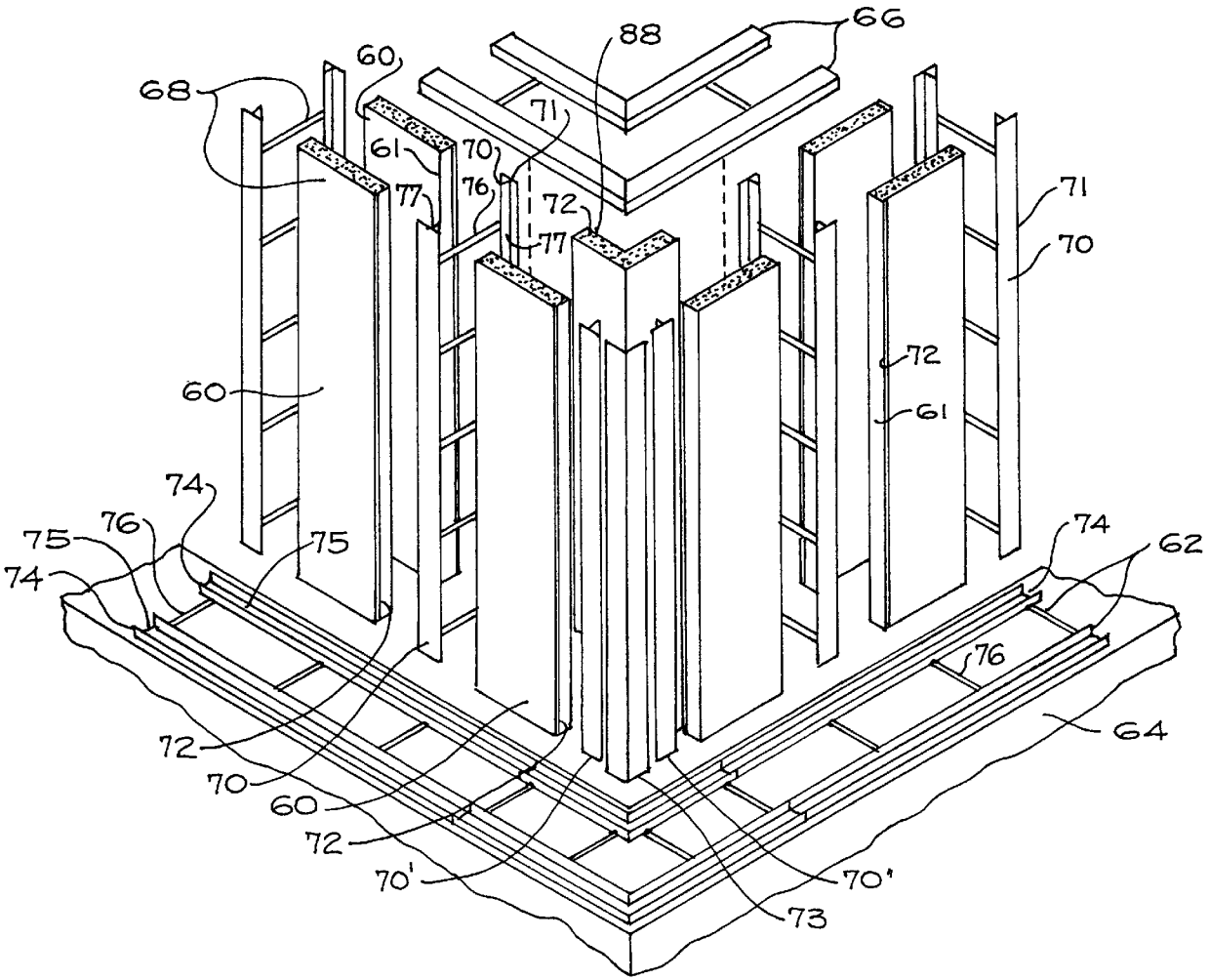
FIG. 19A is an exploded perspective view of a second embodiment of a vertically oriented ninety degree outside corner assembly constructed in accordance with the invention.
FIG. 19B is a perspective view of the vertically oriented ninety degree outside corner assembly of FIG. 19A, showing in addition a means of bracing the corner.
Figure 20:
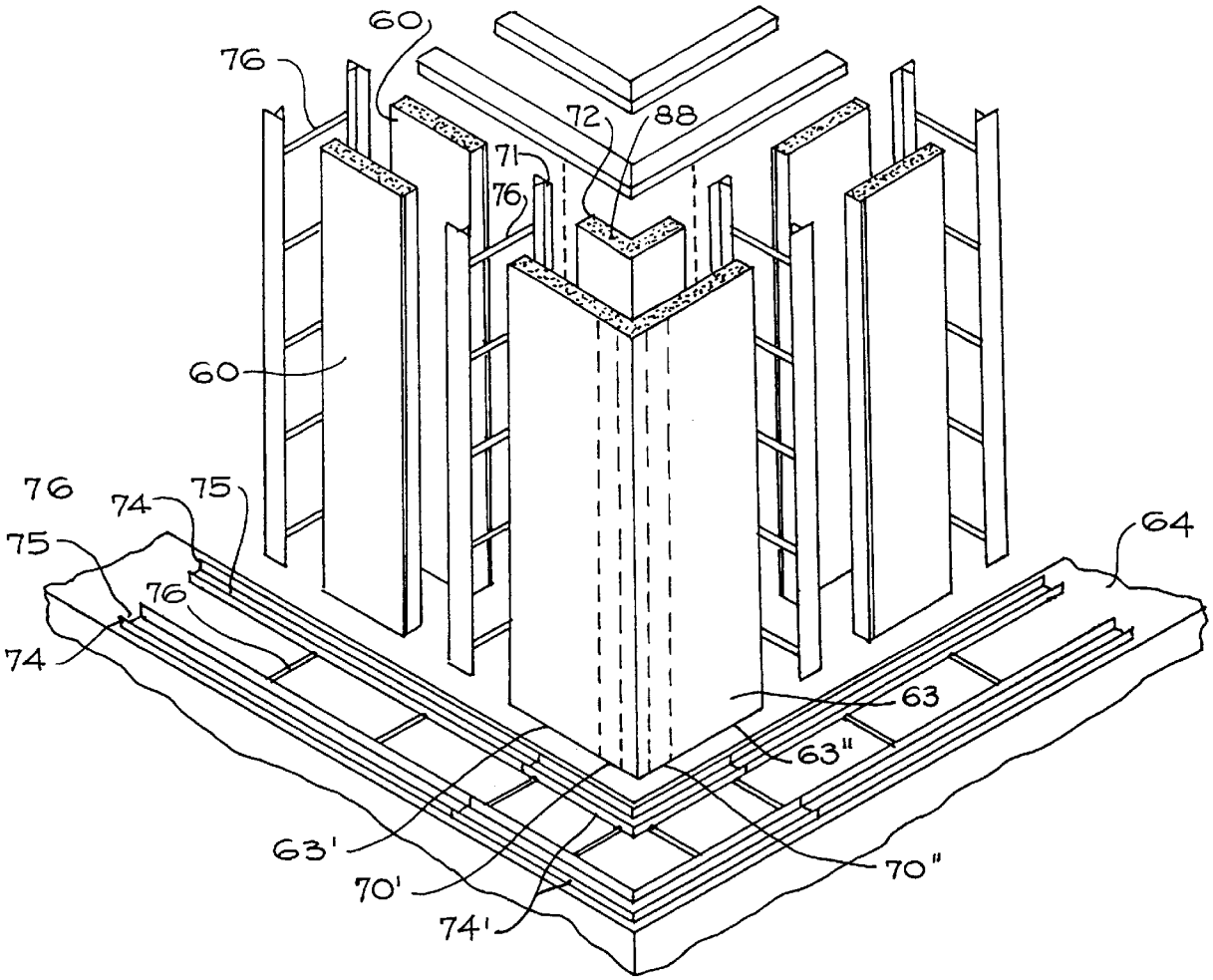
FIG. 20 is an exploded perspective view of a third embodiment of a vertically oriented ninety degree outside corner assembly constructed in accordance with the invention.

FIGS. 19A and 20 show two alternate forms of construction of a ninety degree outside corner. As in FIG. 14, FIG. 19A shows U-shaped members 74 coupled by substantially rigid links 76. In forming the corner in accordance with a preferred embodiment, inner and outer U-shaped members 74' are cut and bent at ninety degree angle, forming portions which extend at a right angle to one another at the corner. The members 74' are coupled to a footing 64 in a manner similar to that in which U-shaped members 74 are coupled to the footing, forming inner and outer channels with channel portions that extend at an angle relative to one another.

Figure 19B:
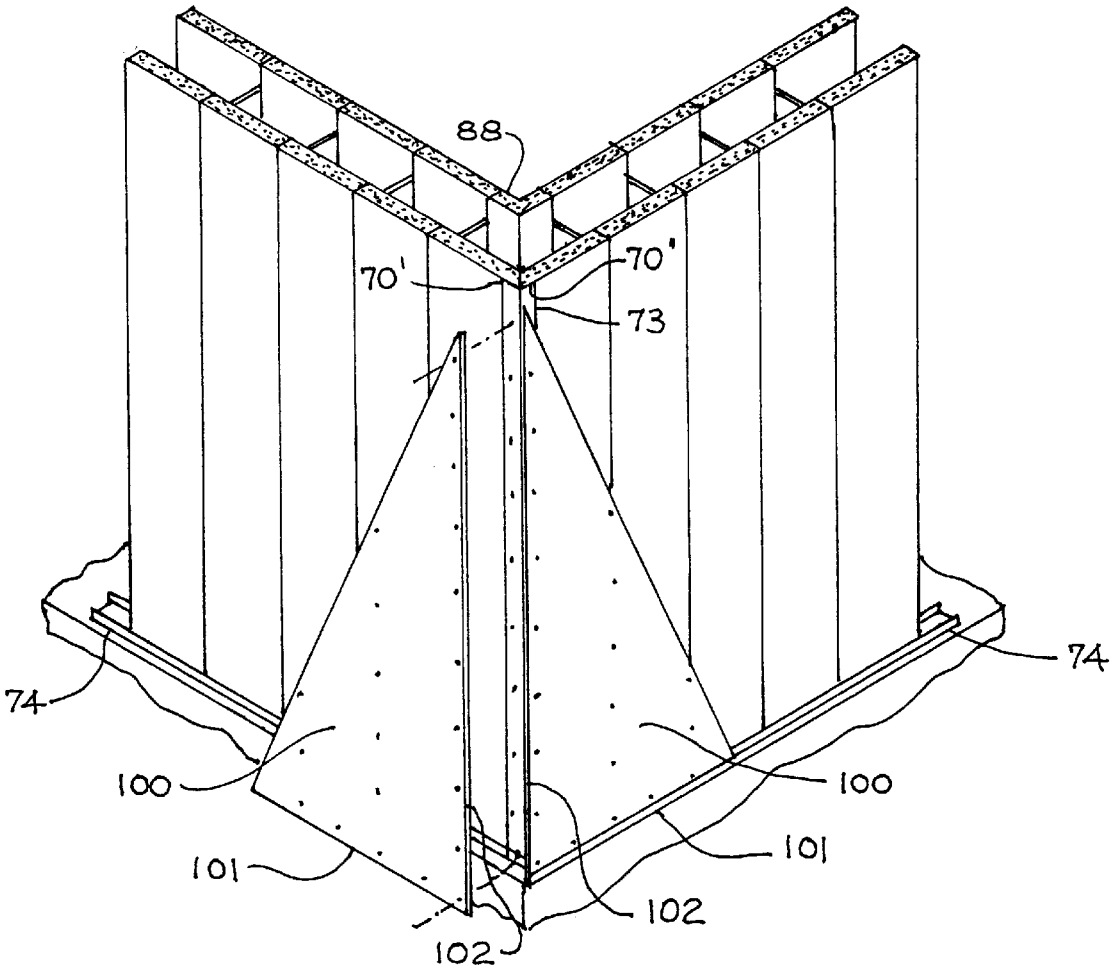

Alternatively, the ends of two U-shaped members can be cut at forty-five degree angle allowing the ends of the members to be butted against one another to form the ninety degree joint at the corner. A right angled member 73 is provided to form the outside corner and is preferably made of steel or extruded plastic or other material similar to that used for the T-shaped members 70. T-shaped members 70' and 70" are attached to the right angled member 73 with drywall screws for example, and cooperate with member 73 when so assembled to form the outside corner element of the form as shown in FIG. 19B. The bottom edges of the corner element formed by 73, 70' and 70" are inserted in a substantially vertical orientation into the channel 75 of the outer U-shaped member 74. The bottom edges of substantially vertically oriented panels 60 are then inserted into the channel 75 of the outer U-shaped member 74 and the panels 60 are coupled to the corner element by inserting the flange 71 of the T-shaped members 70' and 70" into slots 72 in the lateral edge 61 of the panels 60.

FIG. 20 illustrates a preferred embodiment of a ninety degree outside corner. In this embodiment, the outside corner consists of an one-piece, full height corner panel 63 of high density polystyrene material, or any other suitable material, preformed in the shape of an angled corner, with panel portions 63' and 63" extending at an angle to one another, and in the exemplary embodiment, the panel portions 63' and 63" extend at a relative angle of ninety degrees. The corner panel can be eight feet in vertical length, for example. Embedded within the preformed corner piece 63 at or just below the outside surface as shown are two T-shaped strengthening members 70', 70" which provide additional strength to the corner panel 63 as well as provide anchor points for drywall screws.

Figure 15:
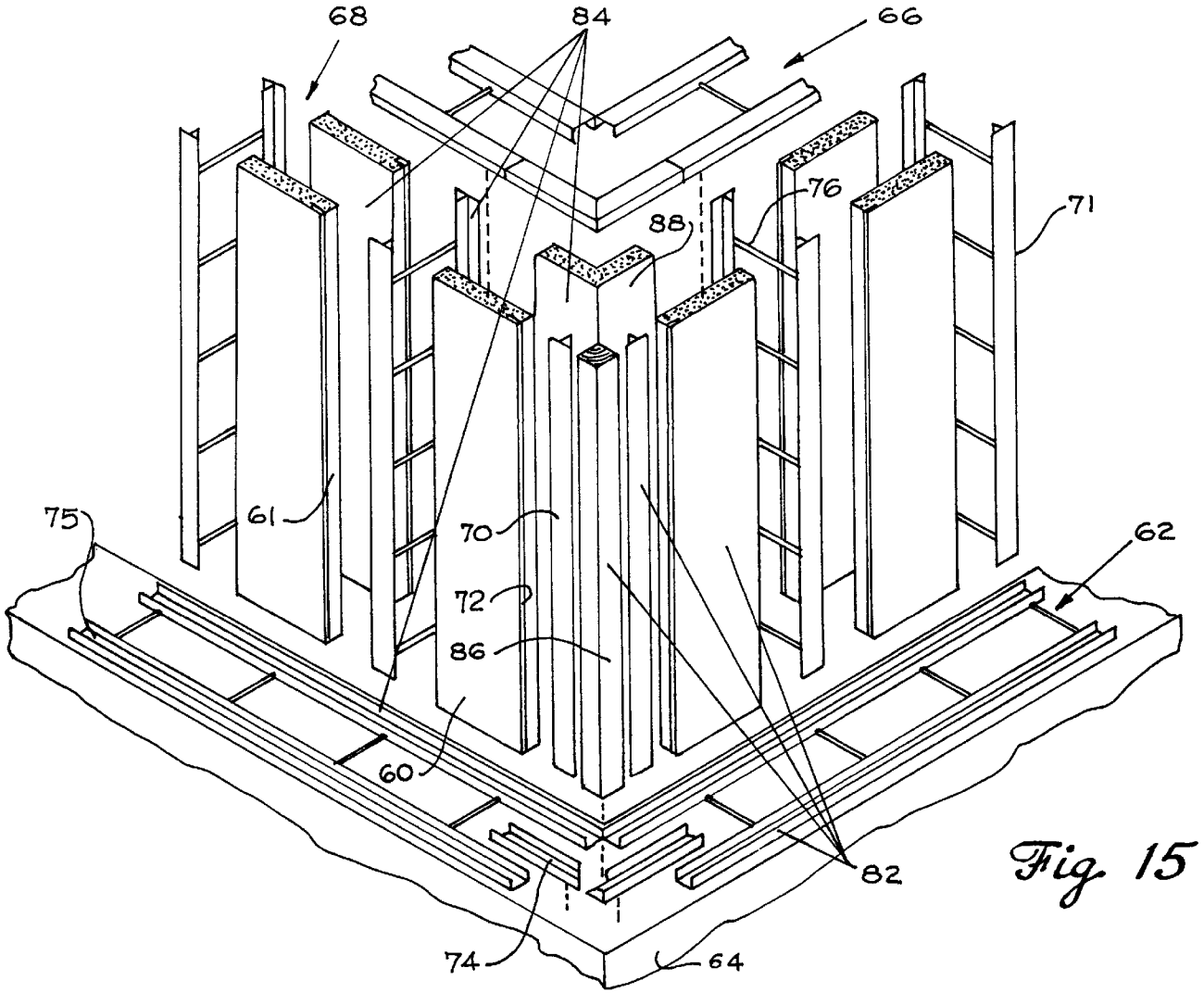
FIG. 15 is an exploded perspective view of a vertically oriented ninety degree outside corner assembly constructed in accordance with one form of the present invention.
Figure 16A:
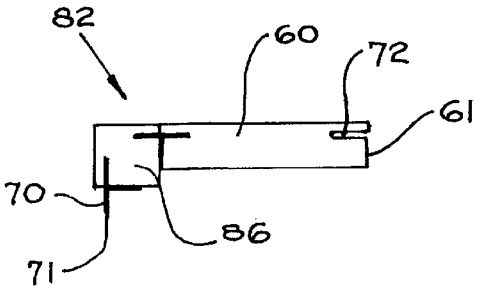
FIGS. 16A–16E illustrate top views of a method of constructing a ninety degree outside corner.
Figure 16B:
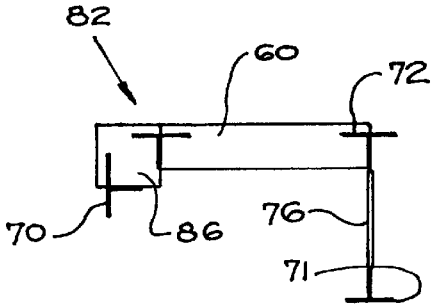
Figure 16C:
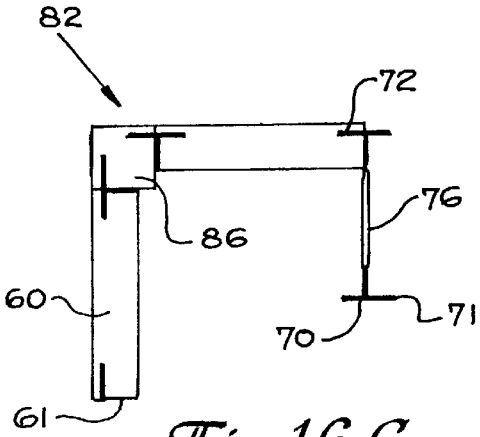
Figure 16D:
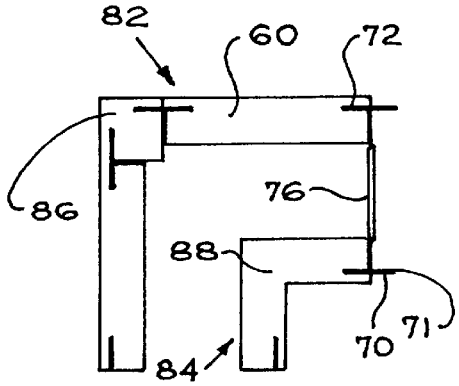
Figure 16E:
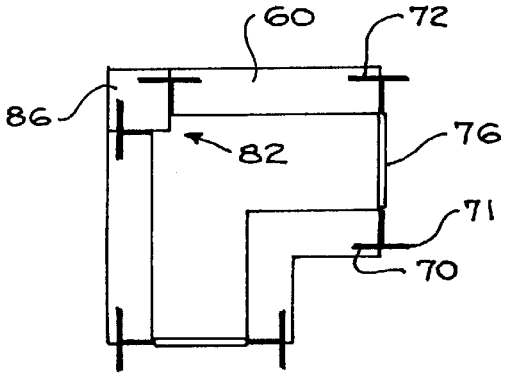

As in the embodiment of FIG. 15, in each of the embodiments shown in FIGS. 19A and 20, a preformed panel 88 in the form of a ninety degree corner is inserted into the channel 75 of the inner shaped members 74 to form the interior of the corner assembly. The bottom edge of a substantially vertically oriented T-shaped member 70, coupled to an opposite T-shaped member 70 by substantially rigid links 76, is inserted into the channel 75 of the inner U-shaped member 74 and the flange 71 of the T-shaped member is inserted into a slot 72 in the lateral edge of the preformed panel 88. The bottom edge of a substantially vertical panel 60 is inserted into the channel 75 of the inner U-shaped member and coupled to the preformed panel 88 by inserting the flange 71 of the T-shaped member 70 into a slot 72 in the lateral edge 61 of the panel 60. Panels 60 and T-shaped members 70 alternately are inserted into the inner and outer U-shaped members 74 until a structure of the desired length is obtained. As in the embodiment of FIG. 15, in each of the embodiments shown in FIGS. 19A and 20, a top cap 66 is placed on the top of a line of panel assemblies 68. Also, as has been pointed out above, the U-shaped members 74 that form the bottom assembly 62, as well as the U-shaped members that form the top cap 66, do not have to be coupled together by links 76, the members 74 of which form the inner and outer channels 75 of the bottom assembly 62 being secured to the footing, and the U-shaped members that form the inner and outer channels for the top cap 66 being independent of one another.

While in the exemplary embodiments, illustrated in FIGS. 19A and 20, the invention is described with reference to forming a ninety degree outside corner, it is apparent that corner assemblies can be provided to form corners for wall sections that extend at angles less than ninety degrees and at angles greater than ninety degrees by suitable shaping of the corner elements 73 and 88 for the wall structure of FIG. 19A or the preformed corner piece 63 and preformed panel 88 for the wall structure of FIG. 20.

FIG. 19B illustrates the vertically oriented ninety degree outside corner assembly of FIG. 19A in assembled form, and further illustrates a means of bracing the corner. Right-angled triangular shaped pieces 100 of reinforcing material of the same height or a substantial portion of the height of the wall to be reinforced are attached to the corner assembly as shown. The bottom edges 101 of each triangular piece are aligned with the bottom U-shaped members 74, and the vertical edges 102 are aligned adjacent the vertical right angled member 73. They are affixed to the wall along the horizontal bottom and vertical side by attaching them to the adjacent U-shaped member 74 and vertical T-shaped member by any convenient means, such as drywall screws.

The reinforcing material may be made of any suitable material, such as metal, plywood or heavy plastic. When installed in the fashion described, the reinforcements protect the corner during construction, and lend additional support to the structure while the concrete or other material to be set in the forms is being poured or during curing.

Figure 21B:
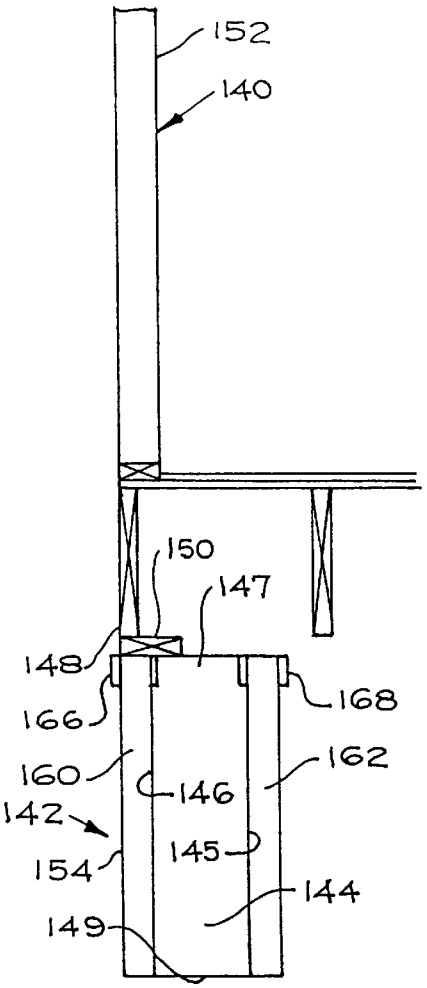
FIGS. 21A and 21B illustrate a portion of a wall and a foundation for a building, the foundation being constructed in accordance with the invention.
Figure 21A:
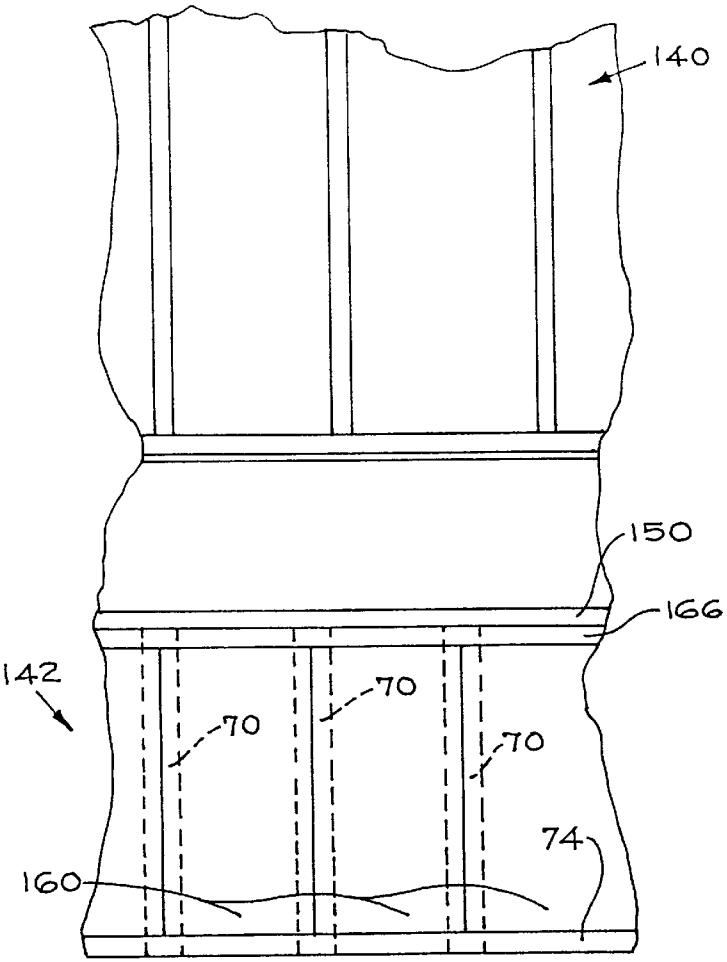

Referring now to FIGS. 21A and 21B, there is illustrated a portion of a wall 140 and a foundation 142 for a building. The foundation 142 is constructed in accordance with the invention and, as shown in FIG. 21B, includes spaced, substantially parallel, vertically oriented inner and outer panels 160 and 162 of a polymer foam material, such as polystyrene, between which concrete 144 or other building material has been poured and allowed to harden, forming a structural member. Panels 160 and 162 correspond to panels 60 shown in FIGS. 14, 15, 19 and 20, for example, and extend in a side-by-side relationship along planar inner and outer surfaces 145 and 146, respectively, of the concrete 144 and from the top or upper edge 147 to the bottom or lower edge 149 of the foundation wall portion formed by the concrete 144.

Referring to FIG. 21A, as has been described above with reference to FIGS. 14, 15, 19 and 20, for example, adjacent panels 160 are connected by vertically extending, T-shaped elongated members 70 which extend the vertical length of the panels 160 and 162. The T-shaped members 70 have their bottom ends mounted in the U-shaped channel members 74, represented by dashed lines in FIG. 21A, and interconnected by links 76 (FIG. 14) in the manner described above. Top caps 166 and 168, which correspond to top caps 66 (FIG. 14) are placed over the tops of the outer panels 160 and the inner panels 162. In this embodiment, the top caps 166 and the U-shaped members (not shown) which support the T-shaped members 70 are not interconnected by links, such as links 76.

The bottom edge 148 of the wall 140 rests on a sill plate 150 that extends the length of the foundation in the conventional manner. The outer surface 152 of the wall 140 has to be substantially flush with the outer surface 154 of the foundation and so approximately one-half of the sill plate 150 overlies the polystyrene panel, as is illustrated in FIG. 21B.

As is known, the load of the wall 140 on the sill plate 150 produces a down pressure on the polystyrene panels 160. The upright T-shaped members 70 act as studs or supports which substantially prevent the sill plate 150 from bowing or cracking as would allow crushing of the polystyrene panels 160 located beneath the sill plate 150. The top cap 166 on the polystyrene panels 160 distributes the wall load along the length of the foundation. In contrast, known polystyrene concrete forming systems, do not provide such support so that the load presented by a wall on the sill plate on which the wall is supported is applied through the sill plate to the underlying polystyrene, crushing the polystyrene in time, and causing the sill plate to bend or crack. This would allow the building to settle, causing damage to the structure.

Figure 22:
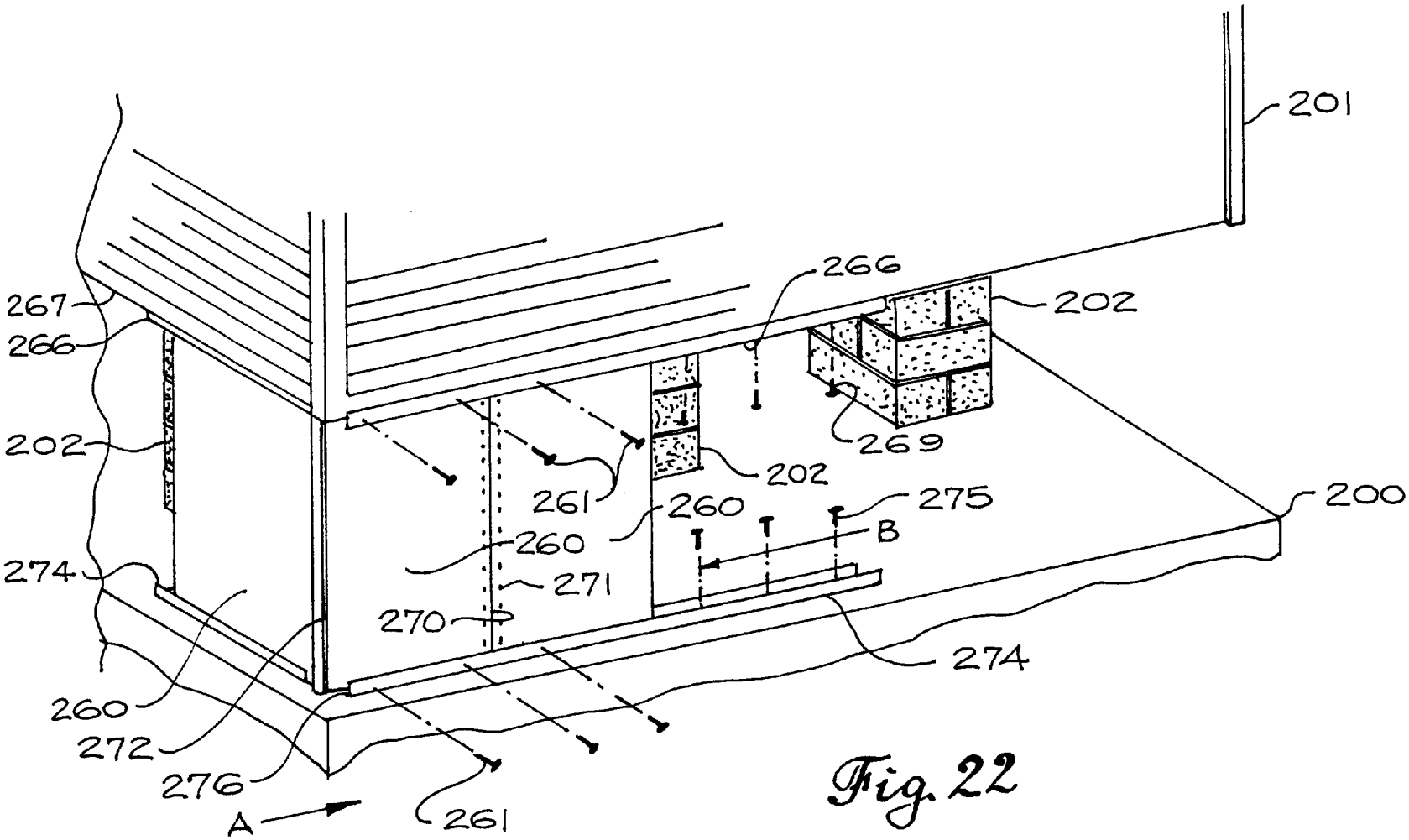
FIG. 22 is a perspective view of an additional embodiment of the invention, showing how the invention may be applied as a skirting system for pre-manufactured homes.

FIG. 22 illustrates a modification of the previously described construction form systems for use with pre-fabricated homes for forming a wall upon a footing. Instead of a double-sided form being constructed as previously described, the invention may be used in a single-sided form in association with pre-fabricated houses which do not require a full foundation.

In the case of many pre-manufactured houses, a poured foundation is not required or is not possible, and the houses are instead set on the ground on supporting pillars. In these cases, a skirting must be applied around the bottom of the house to comply with local building codes, as well as to provide insulation of the house and to keep animals and children from underneath the structure.

The present invention provides an ideal means of forming a wall between the bottom of a pre-fabricated house and a concrete slab footing. In a normal pre-fabricated installation, as seen in FIG. 22, a poured concrete slab 200 is provided as a level base or footing for the siting of the pre-fabricated house 201. Pillars or supports 202 (made from cinder blocks for example in the example shown) are built in the appropriate locations on the slab 200 in order to support the weight of the house when installed upon the supports.

Once the house has been installed onto the supports, the wall of the invention may be formed on the slab between the slab and the house. This is done by securing U-shaped channels 274 to the concrete slab 200 adjacent the perimeter of the house 201 where it is desired to form the wall. The U-shaped channels 274 may be secured to the concrete slab 200 in any convenient fashion such as by means of masonry fasteners 275 for example.

A U-shaped top cap 266 is secured by screws 269 to the rim joist on the underside 267 of the house around its perimeter as shown, and located vertically above the bottom U-shaped channel 274. In the example depicted in FIG. 22, the top cap 266 and bottom U-shaped channel 274 are shown only partially installed on the house. When fully installed, the U-shaped top cap 266 and U-shaped bottom channel 274 would both extend fully along the entire length of the wall or walls to be constructed.

Vertically oriented side panels 260 cut to the correct height to fit are then slid between the U-shaped top cap 266 and bottom channel 274, thereby forming a solid vertical surface between the top cap and the bottom channel. In the example shown, the side panels 260 are made of approximately 2½-inch thick high density material such as expanded or extruded polymer foam or polystyrene. The U-shaped top cap 266 and bottom channel 274 are sized so as to permit the vertical panels to be slid snugly in to the top and bottom channels from an open end, as shown by the arrows "A" and "B" in FIG. 22.

The vertical panels 260 include slots 272 formed in each vertical edge, adapted to receive flanges 271 of T-shaped members 270, permitting the T-shaped members 270 to be fit between adjacent vertical panels 260, providing a reinforced connection between panels and sealing air gaps. The T-shaped members are sized so that they will fit between the U-shaped top cap 266 and bottom channel 274, and are thin enough that they may fit between opposite sides of the channel, thereby permitting the T-shaped members to be fully seated within the U-shaped top cap 266 and bottom channel 274, respectively.

In the example shown, corners are formed by simply leaving a slight gap 276 between the U-shaped channels 274 as shown. The polystyrene panels 260 may then simply be slid together to form a butt joint.

Once in position, the vertical polystyrene panels may then be fixed in place with screws 261 through the sides of the U-shaped top cap 266 and bottom channel 274. Additionally, adjacent vertical panels 260 may be held in place by means of screws into the vertical flanges 271 of vertical T-shaped members 270.

Figure 23:
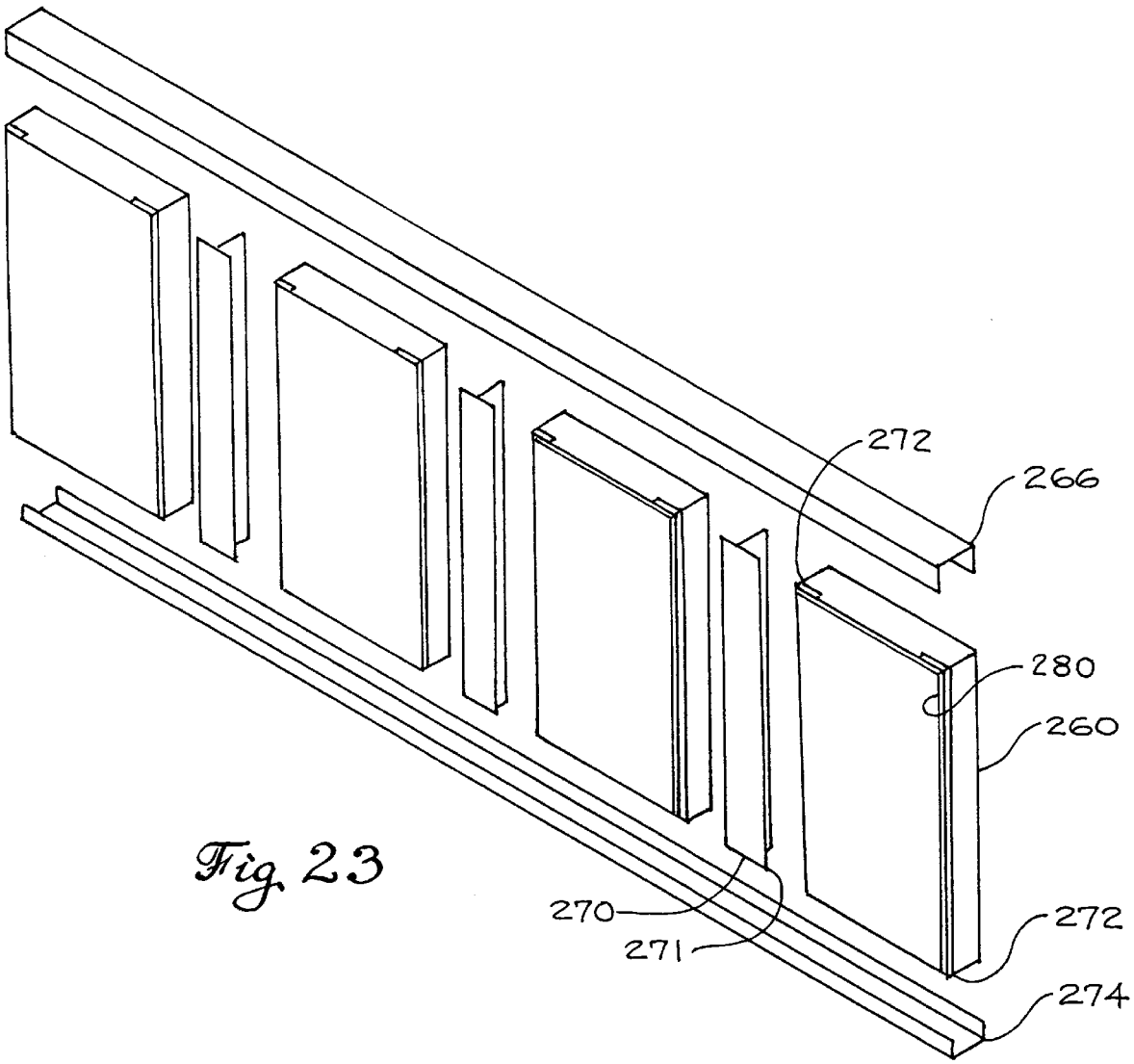
FIG. 23 is an exploded perspective view of the embodiment of FIG. 22, showing the use of T-shaped vertical members.
Figure 24:
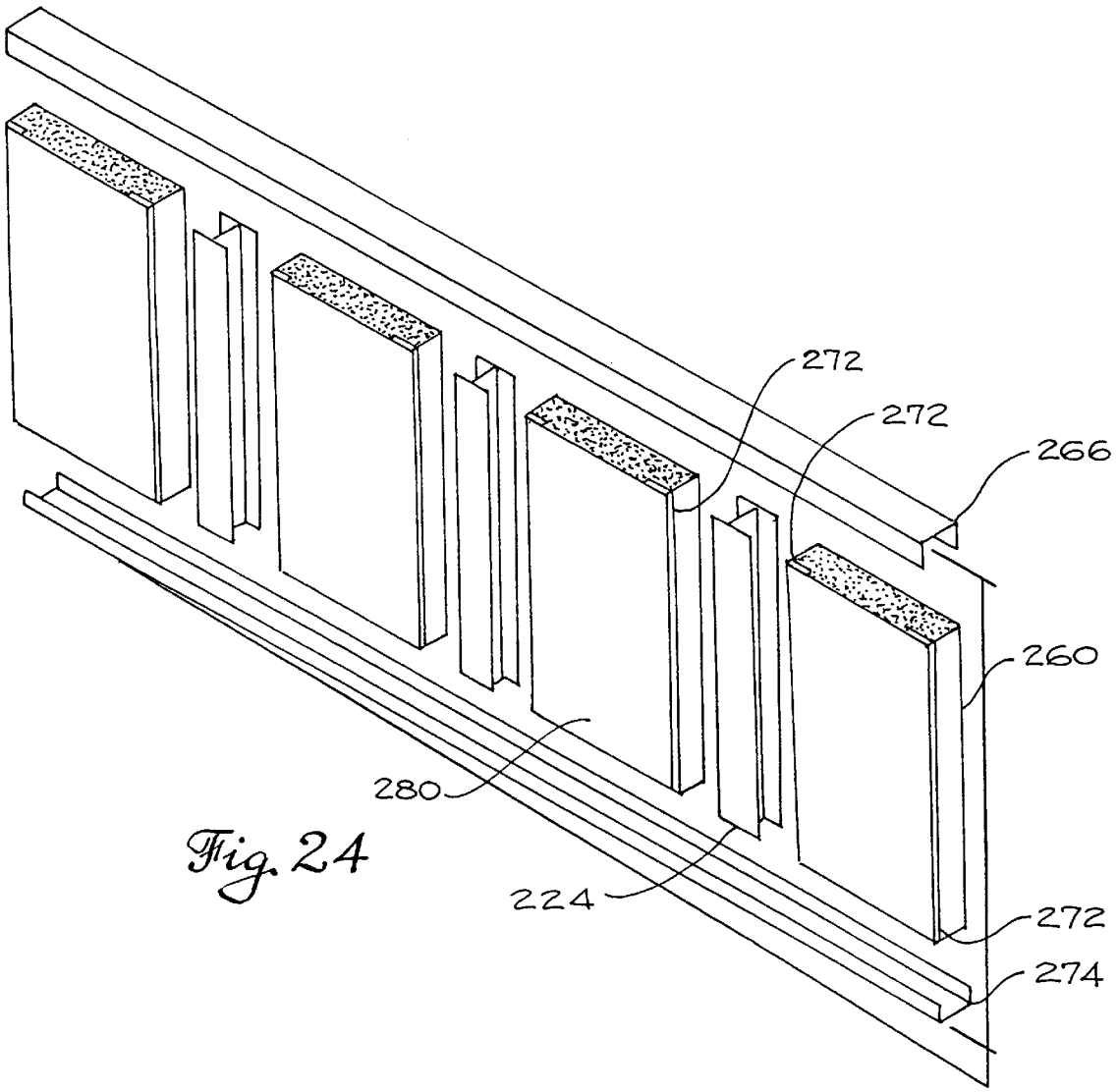
FIG. 24 is an exploded perspective view of the embodiment of FIG. 22, showing the use of H-shaped vertical members.
Figure 24C:
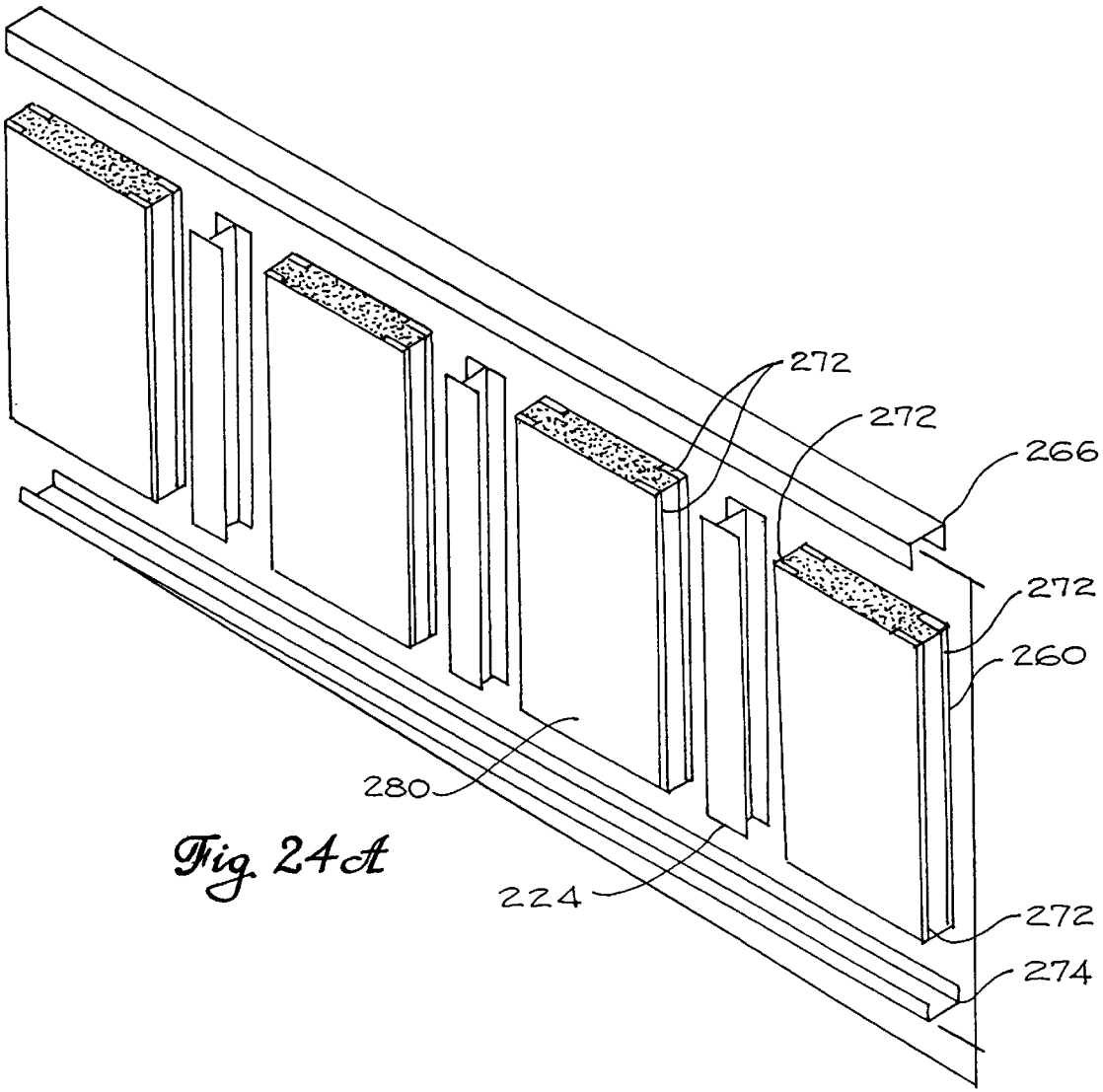
FIG. 24*a* is an explopded perspective view of the embodiment of FIG. 22, showing another use of H-shaped vertical members.

FIG. 23 illustrates in exploded perspective fashion the construction of a side wall in the manner just described, utilizing T-shaped members 270. Alternatively, H-shaped members 224 may be utilized, as shown in FIGS. 24 and 24*a*.

Once all vertical panels have been positioned and fixed, a structural skin coating 280, shown in FIG. 23 for only two of the panels 260 of a hardenable material is then back plastered over the vertical polystyrene panels in order to give the assembled wall the uniform appearance of a poured foundation. By applying parging to the wall in this fashion, it is possible to provide a finished skirting wall indistinguishable to the eye from a normal poured foundation.

Figure 25:
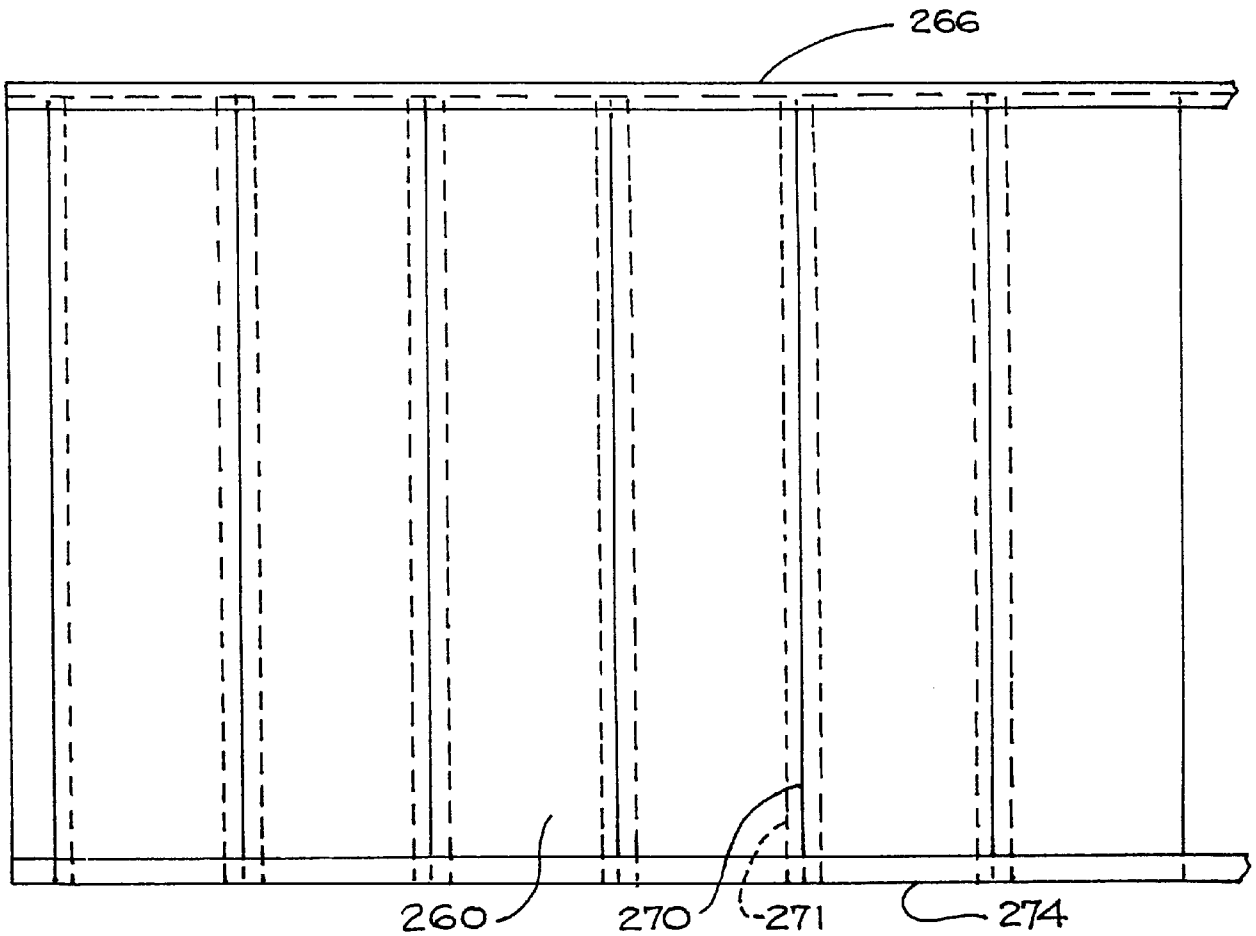
FIG. 25 illustrates the means of adjusting the skirting of FIG. 22 to compensate for uneven installations.

FIG. 25 illustrates a means of adjusting the installation of the wall to compensate for concrete slabs which are not completely level. Because it is not necessary for the vertical panels to be fully seated in the U-shaped top cap 266 so long as they engage the sides of the U-shaped channel adequately, there is some latitude for adjustment of the top cap 266. In the example shown, there is approximately one inch of height adjustment possible between the sides of the wall, as indicated at "d".

In addition, because of the nature of the materials from which they are made, the vertical panels may be easily and quickly custom cut to fit, as may the vertical T-shaped members 270. Accordingly, with the system described by the present invention, it is possible to quickly and cheaply fashion a wall to fit any dimensions, without requiring any special tools.

By utilizing the construction form system of the present invention in this single-sided manner for the construction of side walls, numerous advantages are obtained. The resulting wall (when parged) is indistinguishable to the eye from a normal poured foundation. The wall has sufficient strength to permit backfilling to be done against the wall. The polystyrene panels provide insulation up to an R-11 level, thereby possibly eliminating the need for further insulation. The walls are water resistant, rodent-resistant, wind resistant and child resistant.

The walls may be made adjustable to any height, including uneven heights. For example, it is no more difficult to build a wall 22 inches high at one end and 30 inches high at the other than it is to build a wall the same height throughout. Windows and vents may be easily positioned in the walls simply by cutting the polystyrene panels to the right size to permit them. Automatic venting may be easily installed with vents supplied by third party suppliers.

Figure 26A:
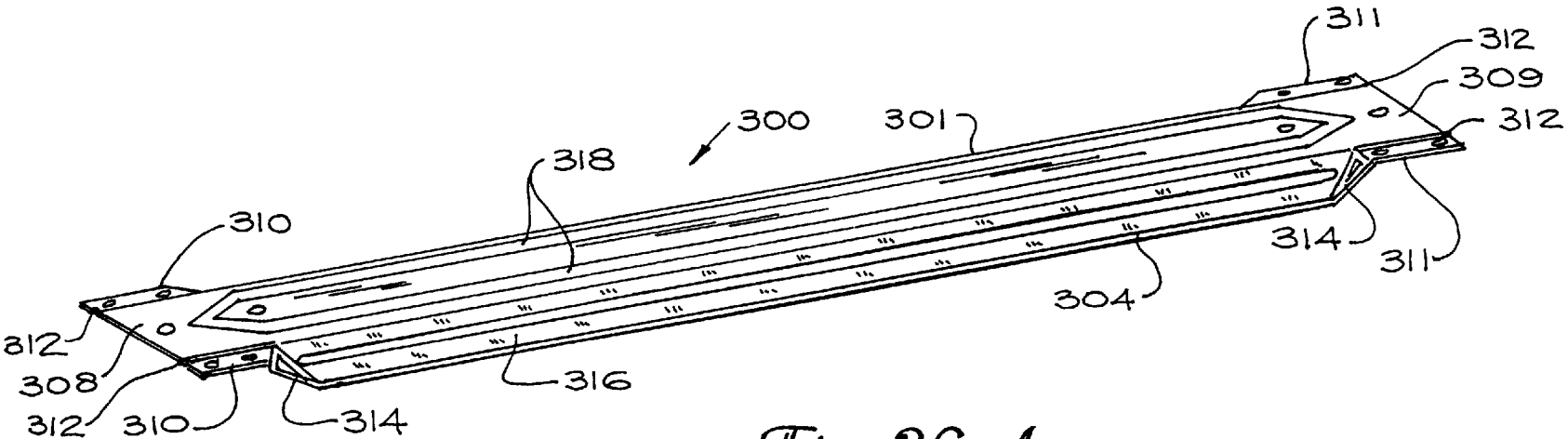
FIG. 26A is a perspective view of an improved link or crosstie for use in maintaining spacing between vertically upright elongate members.
Figure 26B:
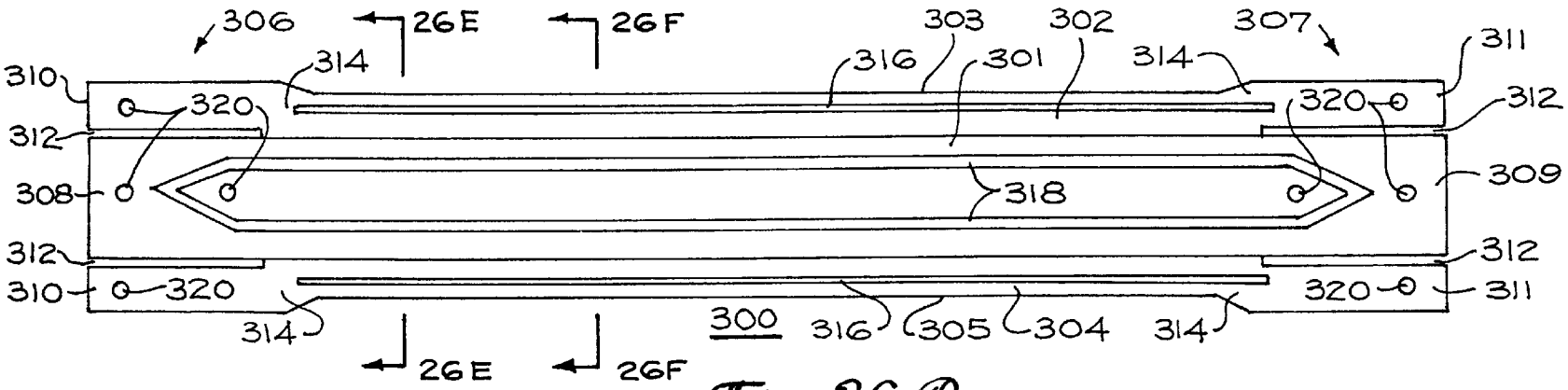
FIG. 26B is a side elevation view of the improved link shown in FIG. 26A.
Figure 26C:
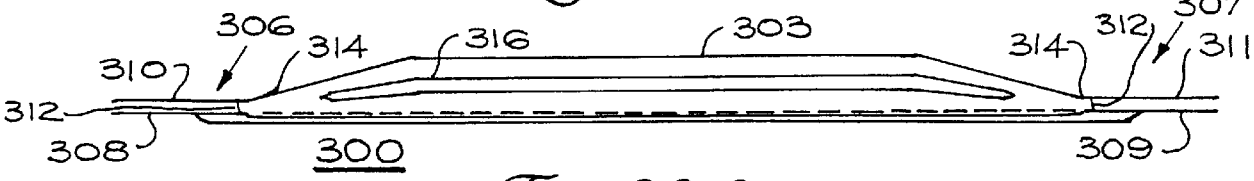
FIG. 26C is a top view of the link of FIG. 26B.
Figure 26F:
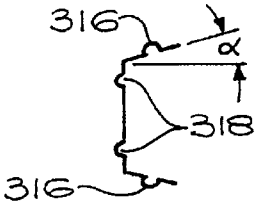
FIG. 26F is a cross-sectional view of the link of FIG. 26B, looking to the left along the lines 26F—26F in FIG. 26B.
Figure 26E:
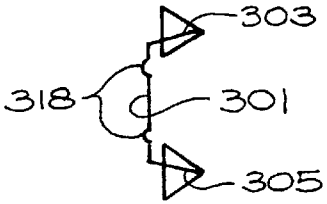
FIG. 26E is a cross-sectional view of the link of FIG. 26B, looking to the left along the lines 26E—26E in FIG. 26B.
Figure 26D:
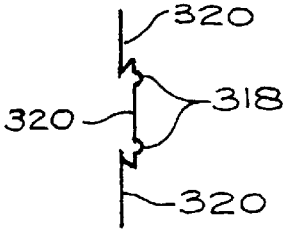
FIG. 26D is an end view of the link of FIG. 26B.

FIGS. 26A, 26B, 26C, 26D, 26E and 26F illustrate an improved link or cross tie 300 which can be used in place of or in addition to the links 76 previously described for maintaining forms, such as panels 60 shown in FIGS. 14, 15, 18, 19A and 20, for example, in a desired spaced relationship until hardenable liquid building material is poured and hardens between the forms. The link 300 includes an elongated body portion 301 having a wing or flange 302 formed on the top edge 303 of the link 300, as viewed in the side elevation view of FIG. 26B, and a flange 304 formed on the bottom edge 305 of the link 300. The flanges 302 and 304 are bent outwardly and rearwardly relative to the plane of the body portion 301 to provide a stiffening effect by giving the link 300 a generally U-shaped profile as shown in FIGS. 26E and 26F, for example. In one embodiment, the flanges were bent at an angle $\alpha$ (FIG. 26F) of approximately of 20° relative to the plane of the body portion 301. However, the flanges can be bent at other angles.

The link 300 further includes connecting end portions 306 and 307 at opposite ends of the body portion 301 which facilitate connection of the link 300 to the leg portions 77 of the vertically oriented T-shaped members 70, shown in FIG. 19A, for example. The connecting end portions are defined by extensions 308 and 309 of the body portion at opposite ends thereof and by the opposite end portions 310 and 311 of the flanges 302 and 303. The flange end portions 310 and 311 are detached from the body portion 301 and lie in a plane that extends parallel to the plane of the body portion 301, spaced rearwardly of the plane of the extensions 308 and 309 of the body portion, as shown in FIG. 26C, defining slots 312. The slots 312 are adapted to receive the vertical leg portion 77 of the T-shaped mounting member 76 (FIG. 19A). The opposing, spaced-apart portions of the link, defined by the extension 308 and the flange end portions 310 at one connecting end portion 306 of the link, are adapted to engage the leg of the T-shaped member on opposite sides thereof. Similarly, the opposing, spaced-apart portions of the link, defined by the extension 309 and the flange end portions 311 at the opposite connecting end portion 307 of the link, are adapted to engage the leg of a further T-shaped member on opposite sides thereof. The flanges 302 and 304 are twisted in the transition regions 314 between the flange end portions 310 and 311 and the flange portion intermediate the end portions to provide the change in orientation between the intermediate portion of the flange and the flange end portions 310 and 311.

Each of the flanges 302 and 304 includes a rib 316 that extends along the flange for providing additional stiffening to the link 300. The length of the rib 316 corresponds approximately to the length of the body portion 301. The link 300 includes further stiffening ribs 318 which extend along the body portion 301 of the link 300 and which converge at the connecting end portions of the link.

Instead of a relatively heavy gauge U-shaped link 76, the link 300 of FIG. 26 can be stamped out of a lightweight metal (24 gauge sheet metal, for example) which is formed to define the outwardly extending flanges 302 and 304 and the end portions 310 and 312 which are connected to the flanges by the twisted regions at both sides, and including strengthening ribs, resulting in a link that is characterized by increased rigidity for a given material thickness. Cuts provided in the twisted regions or pleats near each end, detach the flange ends 310 and 311 from the body portion 310, forming the slots 314 at each end into which the legs 77 of a pair of T-shaped members 76 (FIG. 19A) can be inserted and spot welded at weld projections 320. By way of example, the link 300 can be between about 6.5 inches to 18.5 inches in length and preferably is about 12.5 inches in length. The link can be about 1.75 inches in width between its top and bottom edges and approximately 0.5 inch thick.

As will be apparent to those skilled, with suitable modification of the configuration of the connecting end portions of the link 300, the link 300 can also be used to interconnect the bottom and/or top U-shaped members 74, and can be used in place of the links 28 which interconnect the U-shaped members 26, the H-shaped members 24 to the top cap 29, which are shown in FIGS. 1–13, for example.

While particular embodiments of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A method of forming a wall between a base and an upper support located above the base, the method comprising the steps of:

coupling at least one elongated U-shaped lower member to the base;

coupling at least one elongated U-shaped upper member to the bottom of the upper support vertically above the at least one lower member;

inserting a first substantially vertically oriented planar panel within the lower and upper members to form a vertically oriented wall;

inserting an elongated connecting member substantially vertically between the lower and upper members along a substantially vertical edge of the first panel;

inserting a second substantially vertically oriented planar panel substantially vertically within the lower and upper members to form a substantially vertically oriented wall, such that the elongated connecting member fits substantially vertically along a substantially vertical edge of the second panel between the first and second panels; and then coupling the elongated connecting member to at least one of the first and second panels.

2. The method as claimed in claim 1, wherein the steps of inserting the first and second planer panels includes sliding the first and second panels substantially horizontally between the lower and upper members.

3. The method as claimed in claim 1, wherein the connecting member is concealed upon insertion of the second panel.

4. The method as claimed in claim 1, further comprising the step of coupling the first and second panels to the lower and upper members.

5. The method as claimed in claim 1, further comprising the step of applying a skin coating of material to a side of the wall after assembly to give the wall a uniform appearance.

6. The method as claimed in claim 1, further comprising the step of inserting a first flange of the connecting member into a substantially vertical slot in the substantially vertical edge of the first panel and a second flange of the connecting member into a substantially vertical slot in the substantially vertical edge of the second panel.

7. The method as claimed in claim 6, wherein the connecting member is T-shaped.

8. The method as claimed in claim 1, further comprising the step of inserting a third flange of the connecting member into a second substantially vertical slot in the substantially vertical edge of the first panel and a fourth flange of the connecting member into a second substantially vertical slot in the substantially vertical edge of the second panel.

9. The method as claimed in claim 8, wherein the connecting member is H-shaped.

10. A method of forming a wall between a base and a support located at a higher elevation than the base, the method comprising the steps of:

coupling a lower member to the base;

coupling an upper member to the support;

sliding a first panel substantially horizontally between the lower and upper members; and then coupling a connecting member to the first panel;

sliding a second panel substantially horizontally between the lower and upper members;

coupling the connecting member to the second panel to couple the first panel to the second panel.

11. The method as claimed in claim 10, further comprising the step of coupling the first and second panels to the lower and upper members.

12. The method as claimed in claim 10, further comprising the step of applying a skin coating of material to a side of the wall after assembly to give the wall a uniform appearance.

13. The method as claimed in claim 10, wherein the step of coupling the connecting member to the first panel includes inserting a first flange of the connecting member into a slot in an edge of the first panel.

14. The method as claimed in claim 13, wherein the step of coupling the connecting member to the second panel includes inserting a second flange of the connecting member into a slot in an edge of the second panel.

15. The method as claimed in claim 14, wherein the connecting member is an elongated T-shaped member.

16. The method as claimed in claim 14, wherein the step of coupling the connecting member to the first panel includes inserting a third flange of the connecting member into a second slot in the edge of the first panel.

17. The method as claimed in claim 16, wherein the step of coupling the connecting member to the second panel includes inserting a fourth flange of the connecting member into a second slot in the edge of the second panel.

18. The method as claimed in claim 17, wherein the connecting member is H-shaped.

19. A method of forming a wall between a base and an upper support located above the base, the method comprising the steps of:

coupling at least one U-shaped lower member to the base;

coupling at least one U-shaped upper member to a portion of the upper support above the at least one lower member;

sliding a first panel substantially horizontally between the lower and upper members;

inserting an elongated connecting member between the U-shaped upper and lower members; and then coupling the connecting member to the first panel; and sliding a second panel substantially horizontally between the lower and upper members to form a substantially vertically oriented wall.

20. The method as claimed in claim 19, further comprising the step of coupling the first and second panels to the lower and upper members.

21. The method as claimed in claim 19, further including the step of applying a skin coating of material to a side of the wall after assembly to give the wall a uniform appearance.

22. The method as claimed in claim 19, wherein the first and second panels angularly adjoin one another.

23. The method as claimed in claim 19, further comprising the step of coupling the elongated connecting member to the second panel.

24. The method as claimed in claim 23, wherein the steps of coupling the elongated connecting member to the first and second panels includes the steps of:

inserting a first flange of the connecting member into a slot in an edge of the first panel; and inserting a second flange of the connecting member into a slot in an edge of the second panel.

25. The method as claimed in claim 24, wherein the connecting member is T-shaped.

26. The method as claimed in claim 24, wherein the steps of coupling the elongated connecting member to the first and second panels further includes the steps of:

inserting a third flange of the connecting member into a slot in an edge of the first panel; and inserting a fourth flange of the connecting member into a slot in an edge of the second panel.

27. The method as claimed in claim 26, wherein the connecting member is H-shaped.

* * * * *